US007360508B2

(12) United States Patent
Habib et al.

(10) Patent No.: US 7,360,508 B2
(45) Date of Patent: Apr. 22, 2008

(54) DETONATION / DEFLAGRATION SOOTBLOWER

(75) Inventors: Tony F. Habib, Lancaster, OH (US); Brett R. Burton, Columbus, OH (US); Steven L. Shover, Millersport, OH (US); James H. Hipple, Lancaster, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 11/152,577

(22) Filed: Jun. 14, 2005

(65) Prior Publication Data

US 2006/0005786 A1 Jan. 12, 2006

Related U.S. Application Data

(60) Provisional application No. 60/579,572, filed on Jun. 14, 2004.

(51) Int. Cl.
*F23J 3/02* (2006.01)

(52) U.S. Cl. ..... 122/379; 122/405; 15/316.1; 134/167 R

(58) Field of Classification Search ..... 122/379, 122/396, 405; 15/316.1, 317; 134/167 R, 134/167 C, 172
See application file for complete search history.

(56) References Cited

U.S. PATENT DOCUMENTS

| | | | |
|---|---|---|---|
| 4,089,702 | A | 5/1978 | Enoksson et al. |
| 4,120,699 | A | 10/1978 | Kennedy, Jr. et al. |
| 4,320,528 | A | 3/1982 | Scharton et al. |
| 4,359,962 | A | 11/1982 | Olsson et al. |
| 4,368,677 | A | 1/1983 | Kline |
| 4,396,434 | A | 8/1983 | Forster |
| 4,461,651 | A | 7/1984 | Hall |
| 4,497,282 | A | 2/1985 | Neundorfer |
| 4,645,542 | A | 2/1987 | Scharton et al. |
| 4,655,846 | A | 4/1987 | Scharton et al. |
| 4,699,665 | A | 10/1987 | Scharton et al. |
| 4,905,900 | A | 3/1990 | Scharton et al. |
| 4,923,374 | A | 5/1990 | Lundin et al. |
| 4,980,674 | A | 12/1990 | Scheibel et al. |
| 5,056,587 | A | 10/1991 | Jones et al. |
| 5,082,502 | A | 1/1992 | Lee et al. |
| 5,092,280 | A | 3/1992 | Franklin et al. |
| 5,123,835 | A | 6/1992 | Richards et al. |

(Continued)

FOREIGN PATENT DOCUMENTS

| | | |
|---|---|---|
| EP | 1 067 349 B1 | 1/2004 |

(Continued)

OTHER PUBLICATIONS

YU 172888 (copy not available to Applicants).

(Continued)

*Primary Examiner*—Gregory Wilson
(74) *Attorney, Agent, or Firm*—Brinks Hofer Gilson & Lione

(57) ABSTRACT

A sootblower for cleaning a plurality of surfaces within an interior volume of a combustion device is provided. The sootblower includes a combustion assembly configured to generate a pressure wave and a delivery assembly having an outlet for delivering the pressure wave into the interior volume of the combustion device.

31 Claims, 14 Drawing Sheets

U.S. PATENT DOCUMENTS

| | | | | |
|---|---|---|---|---|
| 5,211,135 | A | 5/1993 | Correia et al. | |
| 5,307,743 | A | 5/1994 | Jones | |
| 5,429,077 | A | 7/1995 | Moskal | |
| 5,494,004 | A | 2/1996 | Hunter, Jr. | |
| 5,517,950 | A | 5/1996 | Kendrick | |
| 5,769,034 | A | 6/1998 | Zilka et al. | |
| 5,800,153 | A | 9/1998 | DeRoche | |
| 5,864,517 | A | 1/1999 | Hinkey et al. | |
| 6,161,506 | A | 12/2000 | Hanson | |
| 6,210,149 | B1 | 4/2001 | Plavnik et al. | |
| 6,321,690 | B1 | 11/2001 | Zilka et al. | |
| 6,438,191 | B1 | 8/2002 | Bickes, Jr. et al. | |
| 6,446,428 | B1 | 9/2002 | Kaemming et al. | |
| 6,604,468 | B2 | 8/2003 | Zilka et al. | |
| 6,655,397 | B2 | 12/2003 | Brown et al. | |
| 6,684,823 | B1 | 2/2004 | Plavnik et al. | |
| 6,764,030 | B2 * | 7/2004 | Habib et al. | 239/566 |
| 2001/0007247 | A1 | 7/2001 | Zilka et al. | |
| 2002/0112638 | A1 | 8/2002 | Zilka et al. | |
| 2003/0015151 | A1 * | 1/2003 | Hipple | 122/379 |
| 2003/0070629 | A1 * | 4/2003 | Bartels et al. | 122/390 |
| 2004/0016226 | A1 | 1/2004 | Lawlor et al. | |
| 2004/0216464 | A1 | 11/2004 | Lupkes | |
| 2004/0266328 | A1 | 12/2004 | Hinkey et al. | |
| 2005/0109231 | A1 | 5/2005 | Bussing | |
| 2005/0112516 | A1 | 5/2005 | Aarnio et al. | |
| 2005/0125930 | A1 | 6/2005 | Flatness et al. | |
| 2005/0125931 | A1 | 6/2005 | Chenevert et al. | |
| 2005/0125932 | A1 | 6/2005 | Kendrick | |
| 2005/0125933 | A1 | 6/2005 | Hochstein, Jr. et al. | |
| 2005/0126511 | A1 | 6/2005 | Henderson | |
| 2005/0126512 | A1 | 6/2005 | Kendrick et al. | |
| 2005/0126594 | A1 | 6/2005 | Chenevert et al. | |
| 2005/0126595 | A1 | 6/2005 | Flatness et al. | |
| 2005/0126597 | A1 | 6/2005 | Hochstein, Jr. et al. | |
| 2005/0130084 | A1 | 6/2005 | Aarnio et al. | |
| 2005/0199743 | A1 | 9/2005 | Hochstein, Jr. et al. | |

FOREIGN PATENT DOCUMENTS

| | | |
|---|---|---|
| YU | P 1728/88 | 3/1990 |
| YU | P 1756/88 | 3/1990 |

OTHER PUBLICATIONS

YU 175688 (copy not available to Applicants).

Pratt & Whitney, Website: http://www.pw.utc.com/shock-system.

Irvin Glassman, Combustion Second Edition, 1986, pp. 182-203.

Kees van Wingerden et al., Detonations in Pipes and in the Open, http://www.safetynet.de/Seiten/artices/CMRNov99.pdf.

John H.S. Lee, Fast Flames and Detonations, 1984 pp. 120-150.

Kuo, pp. 2/10-2/13.

John H.S. Lee, Initiation of Gaseous Detonation, 1977, pp. 75-103.

K. Hanjalic et al., Futher Experience in Using Detonation Waves For Cleaning Boiler Heating Surfaces, 1993, pp. 583-595.

Izet Smajevic et al., Twenty-Years of Experience with On-Load Detonation-Wave Deposit Removal from Gas-Side Boiler Surfaces in a Coal-Fired Power Plant, 2003, pp. 1-7.

EPRI's 4th Intelligent Sootblower Conference, Apr. 2002, Houston, Texas, pp. 10/3-10/8.

Daniel Guggenheim Aeronautical Lab. Air Technical Service Command, 1946, Chapter XII, pp. 404-424.

Paul Kuentzmann et al. Ramjet, Scramjet & PDE, pp. 1-10.

Valveless Pulse Jet, pp. 1-5, http://www.home.no/andreas.sunnhordvik/English/mechanical/valveless_e.htm.

http://www.answers.com/pulse-jet-engine, pp. 1-3.

Huque, Z., Experimental Investigation of Slag Removal Using Pulse Detonation Wave Technique, DOE/HBCU/OMI Annual Symposium, Miami, Fla., Mar. 16-18, 1999.

Hanjali, K. and Smajevi, I., Further Experience Using Detonation Waves for Cleaning Boiler Heating Surfaces, International Journal of Energy Research vol. 17, 583-595 (1993).

Hanjali, K. and Smajevi, I., Detonation-Wave Technique for On-load Deposit Removal from Surfaces Exposed to Fouling: Parts I and II, Journal of Engineering for Gas Turbines and Power, Transaction of the ASME, vol. 1, 116, 223-236, Jan. 1994.

* cited by examiner

DETONATION / DEFLAGRATION SOOTBLOWER

CROSS-REFERENCE TO RELATED PATENT APPLICATIONS

This patent application claims the benefit of U.S. provisional patent application 60/579,572, filed Jun. 14, 2004.

BACKGROUND

1. Field of the Invention

The invention relates generally to a sootblower for removing debris from an interior of a boiler. More specifically, the invention relates to a sootblower that emits a pressure wave into an interior volume of the boiler to remove debris from surfaces located therewithin.

2. Related Technology

During the operation of large-scale combustion devices, such as boilers that burn fossil fuels, slag and ash encrustations develop on interior surfaces of the boiler. For example, boiler tubes that are grouped together as a tube bank and that each extend generally vertically within the boiler interior volume are particularly susceptible to the above-described deposits. The presence of these deposits degrades the thermal efficiency of the boiler. Therefore, it is periodically necessary to remove such encrustations. Various systems are currently used to remove these encrustations.

One such type of system includes a device referred to as a sootblower. Conventional sootblowers project a stream of cleaning fluid, such as air, steam or water, into the interior volume of the boiler. In the case of retracting type sootblowers, a lance tube is periodically advanced into and withdrawn from the boiler and conducts the cleaning fluid to spray from one or more nozzles fastened to the lance tube. As the lance tube is advanced into and withdrawn from the boiler, it may rotate or oscillate in order to direct one or more jets of cleaning fluid at desired surfaces within the boiler. In the case of stationary sootblowers, the lance tube is always maintained within the boiler.

Conventional sootblowers deliver the cleaning fluid, typically steam, into the boiler at a relatively high pressure to facilitate the removal of the encrustations. The high pressure steam typically must be heated and/or pressurized before entering the sootblower, thereby consuming energy and lowering the overall efficiency of the boiler system. In addition, conventional sootblowers depend on direct impact of the fluid stream with the boiler tubes to remove the deposits. As a result, the boiler tubes are often only cleaned on the leading side (the side directly impacted by the fluid stream). Furthermore, the jet penetration may be impeded by an obstruction, such as another boiler tube.

Systems that harness the power of chemically-driven combustion events, such as detonation and deflagration, are beneficial for boiler cleaning because they may have an improved efficiency. More specifically, the combustion events generate pressure waves, which are directed into the boiler interior volume to vibrate the interior components of the boiler and loosen debris therefrom. Additionally, the pressure waves may be more effective tubes than conventional sootblowers at removing deposits from the boiler tubes because the pressure waves are able to reverberate within the deposits. The reverberation is able to travel into the deposit and to wrap around the boiler tubes to effectively loosen the deposits from both the leading side and the trailing side of the boiler tubes.

A shock tube is a tube having an open end and a closed end that is used to generate the detonation or deflagration event. An explosive gas mixture is ignited at the closed end of the shock tube and a deflagration combustion wave is formed and accelerated to the point where transition from deflagration to detonation occurs. The detonation event produces a sharp shock wave having a peak pressure that may be several times greater than a reference pressure, depending primarily on the fuel and oxidizer that are utilized in the shock tube.

Detonation combustion differs from deflagration combustion in that during a detonation event a fuel/oxidizer mixture is detonated rather than burned. Detonation combustion leads to a much greater release of energy than deflagration, thereby creating greater pressures, higher temperatures, and much greater pressure wave velocities. Thus, while the pressure wave velocity due to a deflagration process is typically less than 0.03 times the speed of sound and typically develops a relatively low pressure, the pressure wave or shock wave velocity associated with detonation combustion typically approaches 5 to 10 times the speed of sound and offers pressure differentials of approximately 13 to 55 times greater than the reference pressure.

Stationary detonation or deflagration cleaners include a long, stationary tube positioned outside the boiler walls. The stationary tube is positioned in the opening such that a tube outlet that emits a pressure wave towards the boiler tubes does not extend into the interior volume. Alternatively, the tube slightly extends through the opening such that only a relatively small length of the tube extends into the boiler interior volume. In both of these cases, however, the tube outlet is positioned a relatively large distance from the boiler tubes, thereby reducing the cleaning effectiveness of the pressure wave. More specifically, the pressure wave typically decays in an exponential fashion after exiting the stationary tube. For example, the pressure wave may be able to effectively clean the first row of boiler tubes but not the rows located further away from the stationary tube outlet. Therefore, given the distance between the outlet of pressure wave generator and the boiler tubes, and given the obstruction represented by the banks of boiler tubes, cleaning by a stationary detonation tube may be limited. Furthermore, even if the sootblower is able to produce extremely high pressure waves that maintain enough strength to clean the back rows of boiler tubes, the front rows of boiler tubes may be damaged by the pressure waves, especially those associated with detonation combustion. The stationary detonation/deflagration lance tubes may have an especially limited cleaning effect on tenacious ash deposits.

In another cleaning system currently known in the art, disclosed in U.S. Pat. No. 5,494,004 entitled "ON LINE PULSED DETONATION/DEFLAGRATION SOOT BLOWER", a cleaning apparatus is able to be moved through an inlet opening formed in a boiler wall. The cleaning apparatus includes a pair of elongated housing members that are pivotable with respect to each other to move between a folded position and a partially extended position. More specifically, when the housing members are in the folded position, the cleaning apparatus is able to be extended through the boiler wall inlet. Once inside the boiler, the pivoting housing member is pivoted to an angle Ø (FIG. 3) generally equal to 45 degrees so that pressure waves are able to be directed into the boiler. More specifically, the downstream end of the pivotable housing member includes a deflagration/detonation combustor for generating and emitting pressure waves into the boiler. However the weight of the portion of the sootblower that is extended into the boiler is greatly increased by locating the combustor within the pivotable housing member and thereby extending the combustor into the boiler. Therefore, due to structural limitations on the housing members, the sootblower is unable to be extended a substantial distance into the boiler. Additionally, because the deflagration combustor is located at the end of the pivotable housing member, the sootblower has a relatively small run-up distance, which will be discussed in more detail below. Furthermore, the pivotable-housing sootblower is unable to emit pressure waves into the boiler while traversing therein because the device cannot fit through the boiler wall opening when the housing members are partially extended and cannot emit pressure waves in a desired direction when the housing members are folded.

During operation of currently known, combustion-event cleaners, the pressure wave may fail to occur or may be undesirably weak due to various factors. For instance, if the mixture of the fuel and the oxidizer is not proper, then detonation or deflagration may not occur. If the pressure wave is not effective, the boiler tubes may experience undesirable deposit build-ups, which could reduce boiler efficiency or cause boiler shutdown. Although some currently-known combustion-event cleaners include a detonation/deflagration detection system, this system operates by measuring pressure waves generated by the cleaner, which may be difficult. More specifically, the pressure waves generated by the cleaner are in the range of microseconds and a direct data sampling is therefore not feasible.

It is therefore desirous to provide a combustion-event sootblower that is able to effectively loosen deposits from surfaces within a boiler and that is able to effectively detect unsuccessful detonation or deflagration.

SUMMARY

In overcoming the limitations and drawbacks of the prior art, the present invention provides a sootblower for cleaning a plurality of surfaces within an interior volume of a combustion device. The sootblower includes a combustion assembly configured to generate a pressure wave, a delivery assembly having an outlet for delivering the pressure wave into the interior volume of the combustion device, and a translating assembly to selectively position the outlet portion of the delivery assembly within the interior volume of the combustion device. The delivery assembly defines a pressure wave path extending in a substantially linear direction between the combustion assembly and the outlet portion of the delivery assembly to substantially prevent degradation of the pressure wave within the delivery assembly.

In one preferred design, the outlet portion includes a generally non-linear portion to guide the pressure wave towards the surfaces of the combustion device. For example, the non-linear portion is generally arcuate-shaped and defines a generally gradually-angled path to minimize degradation of the pressure wave within the outlet portion.

In another preferred design, the outlet portion includes a pair of diametrically opposed nozzles. Additionally, the outlet portion is preferably configured to rotate with respect to the surfaces of the combustion device to control a projection of the pressure wave.

The combustion assembly preferably generates the pressure wave via a deflagration event or via a detonation event.

For a detonation sootblower, the delivery assembly preferably includes at least one obstruction positioned along the pressure wave path to increase the velocity of the deflagration flame. The increased velocity of the deflagration flame causes a velocity gradient of layers of unburned gases, which increases the mass burning rate of the gases and initiates detonation. In one design, the obstruction is a generally spiral-shaped ridge extending from a wall of the delivery assembly. The obstruction is preferably integrally formed with a wall of the delivery assembly.

In another preferred design, the combustion assembly includes an ignition chamber configured to receive fuel and an oxidizer, an obstruction to increase turbulence within the ignition chamber and to promote mixing of the fuel and the oxidizer, and an ignition element configured to ignite the fuel. Additionally, the ignition chamber diameter is preferably 1 to 3 times greater than the delivery assembly diameter. Furthermore, the ignition chamber axial length is 1 to 4 times greater than the ignition chamber diameter.

In another aspect of the present invention, the sootblower includes a combustion detection assembly having a temperature sensor coupled to the combustion assembly or the delivery assembly to measure a sootblower temperature for detecting an unsuccessful detonation/deflagration event. The sootblower in this design preferably includes a controller that is electrically connected with the temperature sensor to control the combustion assembly. For example, the controller is preferably configured to control the combustion assembly based on a gradient of the sootblower temperature. More specifically, the controller is configured to deactivate the combustion assembly if the gradient of the sootblower temperature is less than a threshold, and in some events if the absolute temperature exceeds a maximum temperature threshold.

In another aspect of the present invention, the sootblower includes a delivery assembly defining a pressure wave path extending between the combustion assembly and an outlet portion of the delivery assembly and the pressure wave path has an adjustable length. The delivery assembly preferably includes a lance tube and a feed tube slidably received within the lance tube to define an overlapping portion having an adjustable overlapping length. Additionally, the lance tube is preferably movable between a first position second section, wherein a portion of the lance tube positioned within the interior volume in the second position.

In another aspect of the present invention, a method of cleaning the surfaces within the combustion device is provided. The method includes the steps of: generating a pressure wave within the combustion assembly, translating the delivery assembly along a path extending into the interior volume of the combustion device, and delivering the pressure wave to the interior volume of the combustion device to remove deposits from the surfaces of the combustion device while translating the delivery assembly along the path.

The method also preferably includes the step of measuring an oxygen content within the combustion assembly after, and/or before, a combustion event. Additionally, the method preferably includes the step of controlling the combustion assembly based on an electrical signal.

Further objects, features and advantages of this invention will become readily apparent to persons skilled in the art after a review of the following description, with reference to the drawings and claims that are appended to and form a part of this specification.

DETAILED DESCRIPTION

Figure 1:
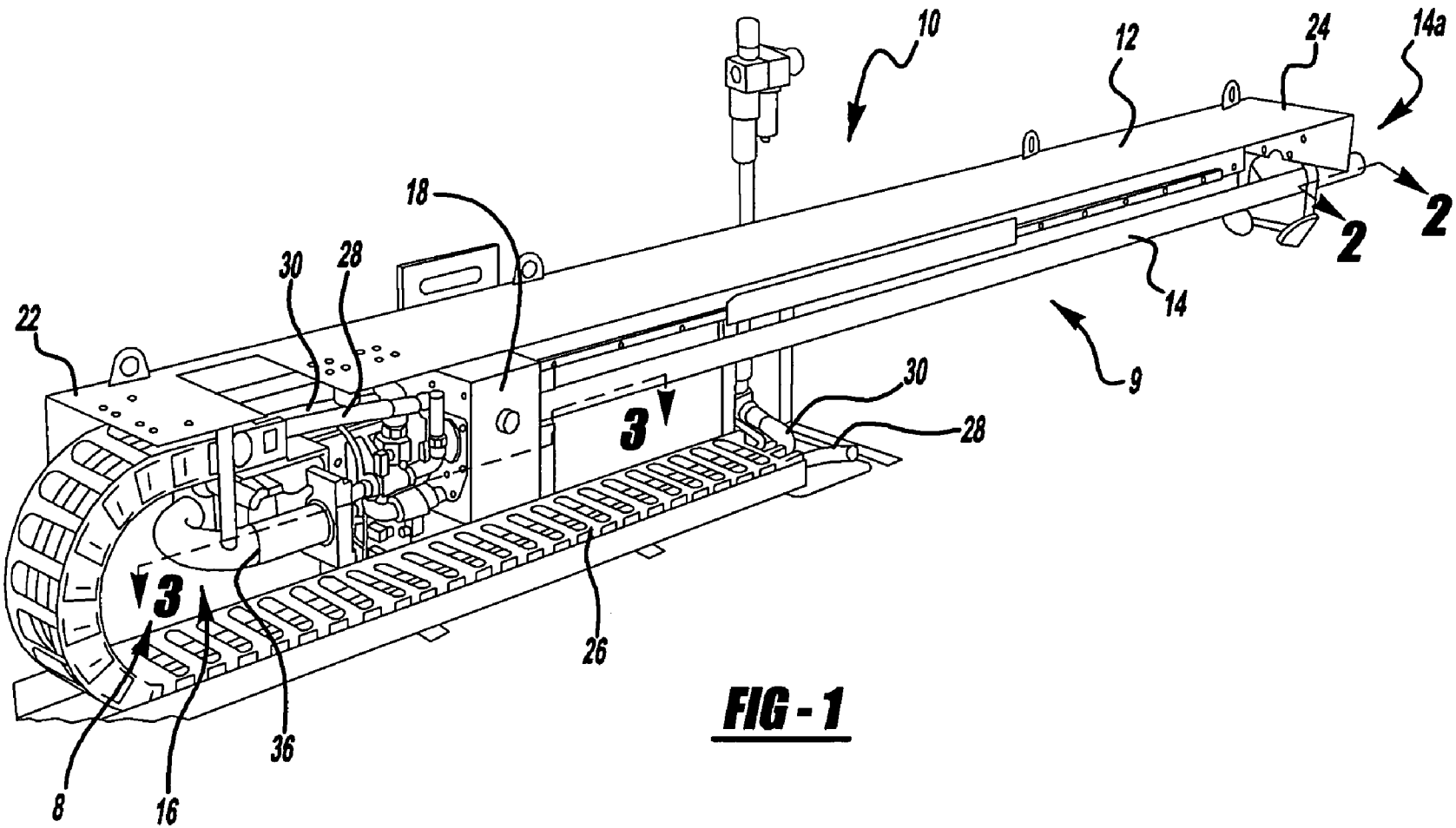
FIG. 1 is a long, retracting type sootblower having a retractable lance tube and a combustion assembly for delivering a pressure wave to the lance tube, where the sootblower embodies the principles of the present invention.
Figure 2A:
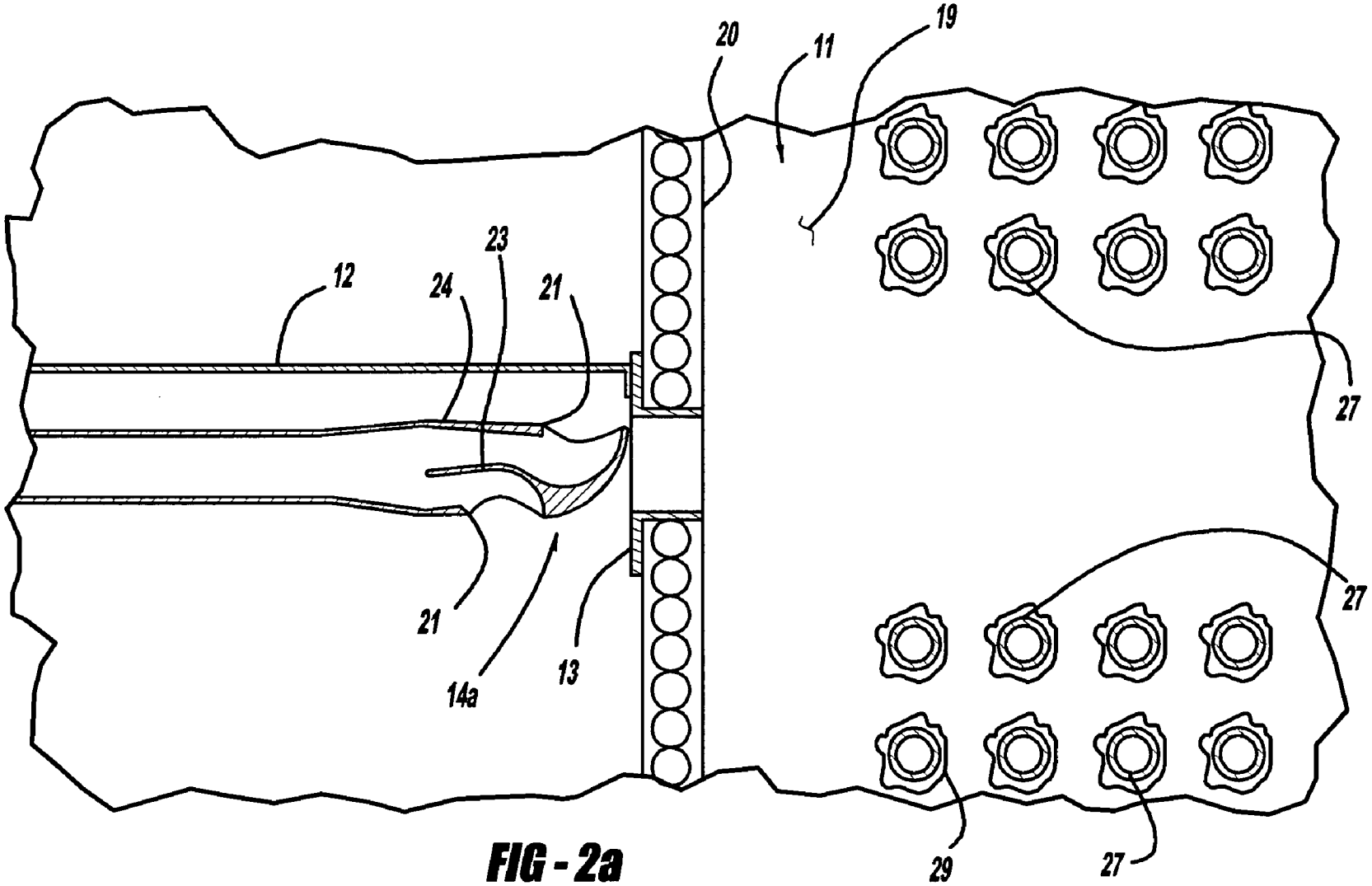
FIG. 2*a* is a cross-sectional of the lance tube taken along line 2-2 in FIG. 1, where the lance tube is positioned adjacent to and retracted from a boiler wall.
Figure 2B:
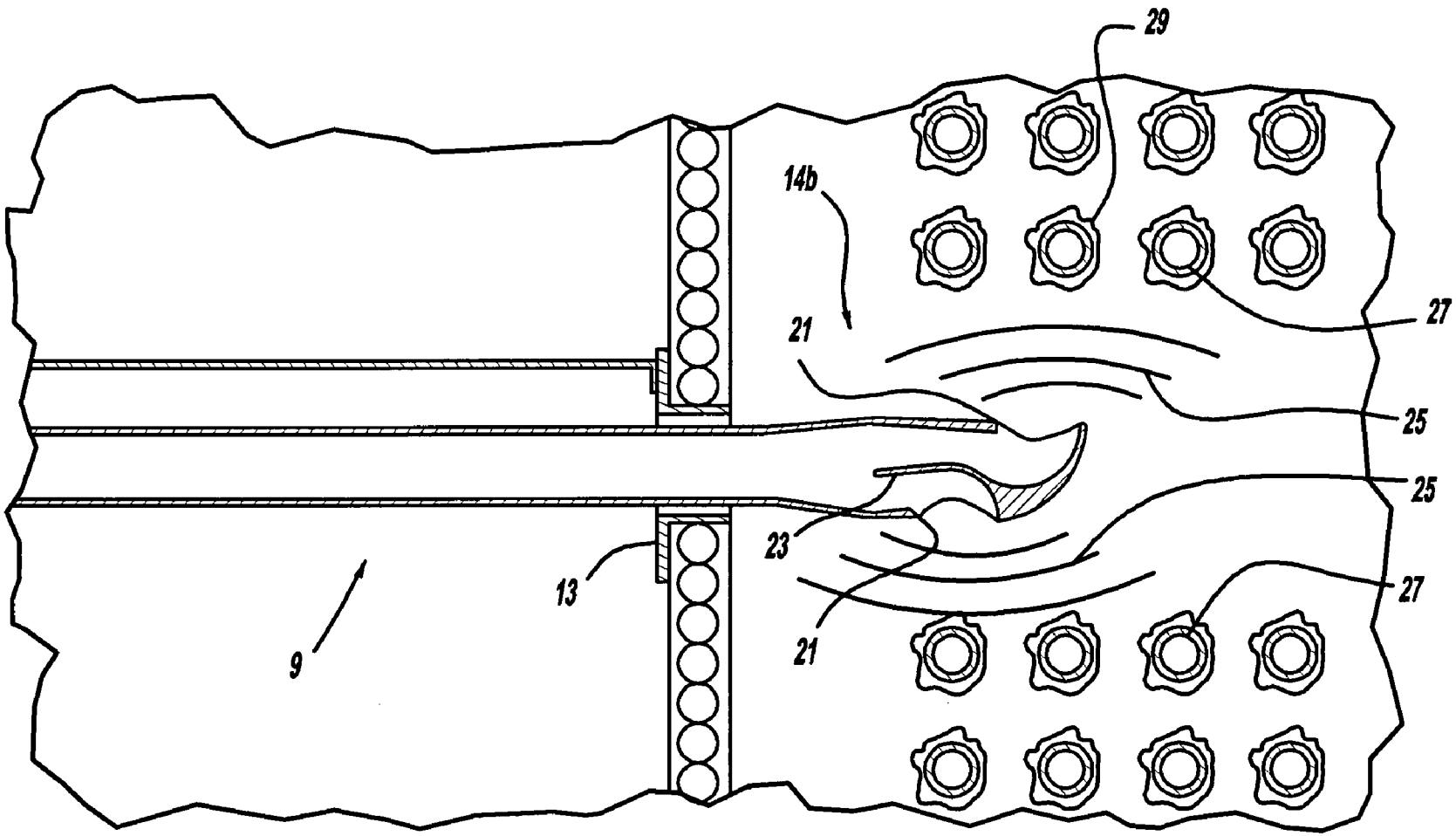
FIG. 2*b* is a cross-sectional of the lance tube similar to that shown in FIG. 2*a*, where the lance tube is advanced through the boiler wall and into the boiler interior volume.

Referring now to the drawings, FIGS. 1 and 2 show a sootblower 10 embodying principles of the present invention for cleaning a combustion device, such as a boiler 11. The sootblower 10 principally includes a combustion assembly 8 for generating a pressure wave 25 and a delivery assembly 9 for delivering the pressure wave to the boiler 11. For example, the combustion assembly includes an ignition assembly 16, a feed tube 15 (FIG. 3), and a portion of a lance tube 14 that each experience combustion therewithin to generating the pressure wave 25. Additionally, the delivery assembly 9 includes the remaining portion of the lance tube 14 and an outlet portion such as a nozzle 21 for delivering the pressure wave to the boiler. The sootblower 10 shown in the figures is a translating sootblower, a portion of which is advanced into and retracted from an interior volume 19 of the boiler by a carriage 18 as will be discussed in more detail below. The sootblower 10 is shown in a normal resting position 14*a* in FIGS. 1 and 2*a*. Upon actuation, the lance tube 14 is extended into the boiler interior volume 19 to an operational position 14*b* shown in FIG. 2*b*.

During operation of the sootblower 10 shown in the figures, when the lance tube 14 is advanced into the interior of the boiler a cleaning medium is discharged from one or more nozzles 21 located adjacent to the distal end of the lance tube 14. In one design, the nozzles 21 direct the pressure waves 25 at an angle with respect to the lance tube 14 longitudinal axis, such as the 90 degree angle shown in FIGS. 2*a* and 2*b*. In an alternative design however, shown in FIG. 12*b*, the pressure waves 25 are emitted from the lance tube 14 in a direction parallel to that of the lance tube 14 longitudinal axis. The cleaning medium is preferably produced by combusting a fuel such as a flammable gas, liquid, or solid inside the ignition assembly 16. For example, a predetermined amount of flammable gas and an oxidant are introduced into the ignition assembly 16 where it is ignited to initiate the deflagration combustion. As a result, the combustion flame travels out of the ignition assembly 16, through the feed tube 15, and into the lance tube 14 where it accelerates to a point where transition from deflagration to detonation occurs and the pressure wave 25 transforms into a shock wave. The shock wave is then emitted from the lance tube nozzle 21 into the boiler interior volume 19 and impacts the surfaces to be cleaned. For example, the pressure wave 25 (FIGS. 2*a* and 2*b*) deans a plurality of boiler tubes 27 located within the boiler interior volume 19 that are encrusted with deposits 29 of soot and other debris from normal operation of the boiler 11. More specifically, the pressure wave 25 typically reverberates within the deposits 29 to loosen and remove the deposits 29 from the boiler tubes 27. The combustion process is repeated in a cyclic fashion at a desired frequency, thereby causing the pressure waves 25 to hit the boiler tubes 27 at the desired frequency.

The frame assembly 12 shown in FIG. 1 is located above the lance tube 14 and the carriage 18 and extends along of the respective components 14, 18 to provide protection thereto. The carriage 18 is guided along tracks (not shown) located on opposite sides of frame assembly 12 to enable longitudinal movement of carriage 18 between the normal resting position 14*a* and the operational position 14*b*. The frame assembly 12 includes a proximal end 22 generally supporting the carriage 18 and a distal end 24 that is adjacent to and/or connected to a boiler wall 20. More specifically, the distal end 24 of the frame assembly 12 is preferably connected to a wall box 13 defining an opening in the boiler wall 20. The carriage 18 drives lance tube 14 into and out of the boiler 11 via a drive motor and a gear box (not shown). In the design shown in the Figures, the combustion assembly 8 translates along with the lance tube 14 during actuation of the carriage 18. Therefore, a flexible linkage 26 encloses and protects any necessary input lines that are connected to the combustion assembly, such as a fuel supply hose 28 and an air supply hose 30, to enable longitudinal movement of the supply hoses 28, 30 along with the combustion assembly 8.

Figure 13A:
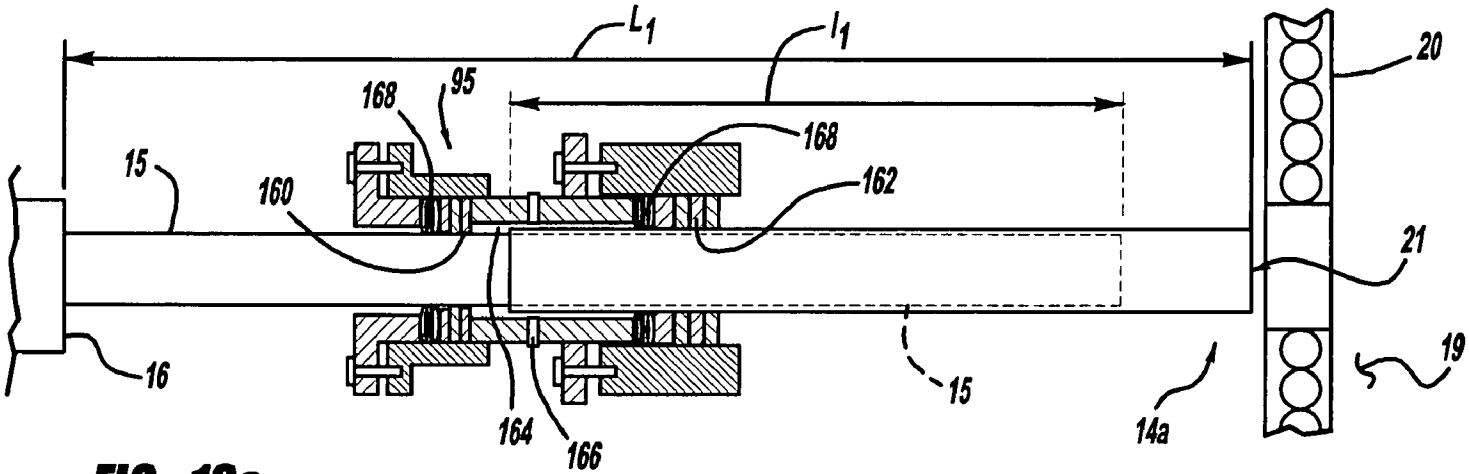
FIGS. 13*a* and 13*b* is a lance tube in an alternative design embodying the principles of the present invention.
Figure 13B:
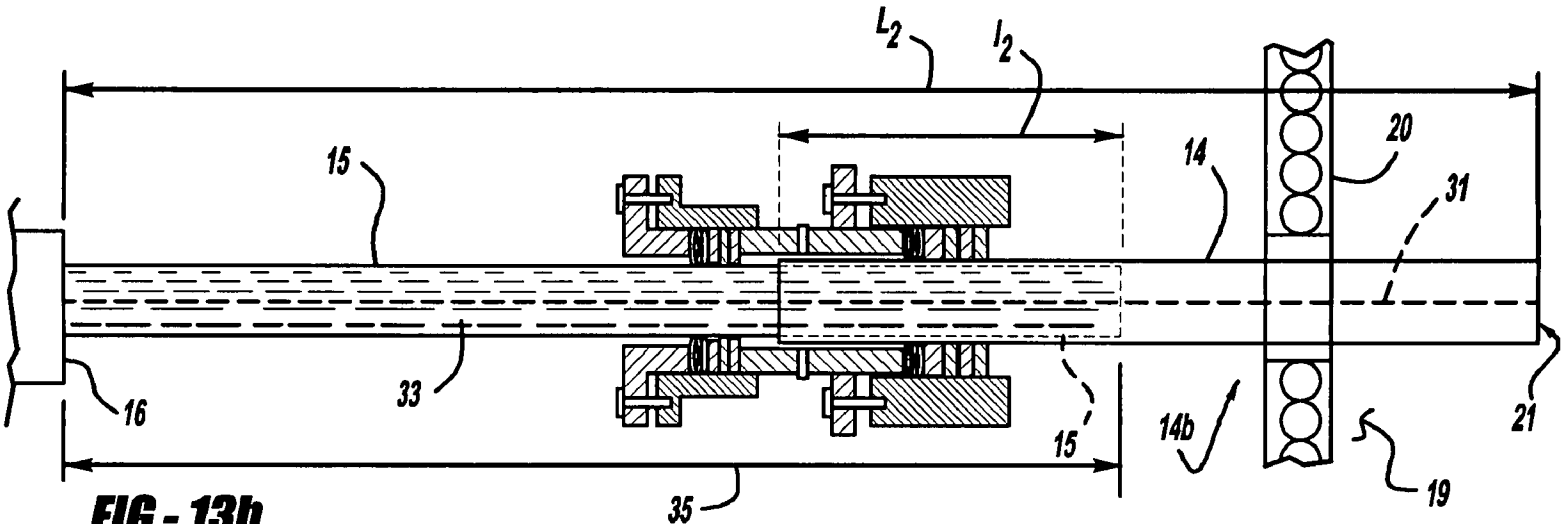

However, in an alternative design shown in FIGS. 13*a* and 13*b*, the combustion assembly 8 remains stationary while the lance tube 14 is extended into the boiler interior volume 19. In this design, the feed tube 15 is preferably received within the lance tube 14 in a telescoping manner to form an adjustable-length component having an overlapping length between the lance tube 14 and the feed tube 15. For example, when the lance tube 14 is in the normal resting position 14*a* in FIG. 13*a*, the feed tube 15 and the lance tube 14 cooperate to have an effective length of $L_1$ and have an overlapping length of $l_1$. Similarly, when the lance tube 14 is in the operational position 14*b* in FIG. 13*b*, the feed tube 15 and the lance tube 14 cooperate to have an effective length of $L_2$ and have an overlapping length of $l_2$, where $L_2$ is greater than $L_1$ and $l_2$ is smaller than $l_1$. Additionally, as discussed above, the nozzle 21 is located outside of the boiler interior volume 19 when the lance tube 14 is in the normal resting position 14*a* and located inside of the boiler interior volume 19 when the lance tube 14 is in the operational position 14*b*. As discussed above, when the lance tube 14 is in the operational position 14*b*, pressure waves 25 are able to be delivered along a pressure wave path 31 between the ignition assembly 16 to the boiler interior volume 19. This configuration is especially beneficial because the ignition assembly 16 is able to remain in place while the lance tube 14 traverses into the boiler interior volume and emits pressure waves thereinto, thereby reducing premature wear on the ignition assembly 16 and potentially simplifying the carriage 18 and the frame assembly 12. Furthermore, the adjustable length of the delivery assembly creates a potentially longer fill length and a greater maximum pressure for the pressure waves 25.

The feed tube 15 and the lance tube 14 filled with a mixture of fuel and oxidant 33 to a fuel/oxidant fill length 35 to adjust an intensity of the pressure waves 25. For example, the greater the fuel/oxidant fill length 35, the greater the intensity of the pressure waves 25.

Figure 3:
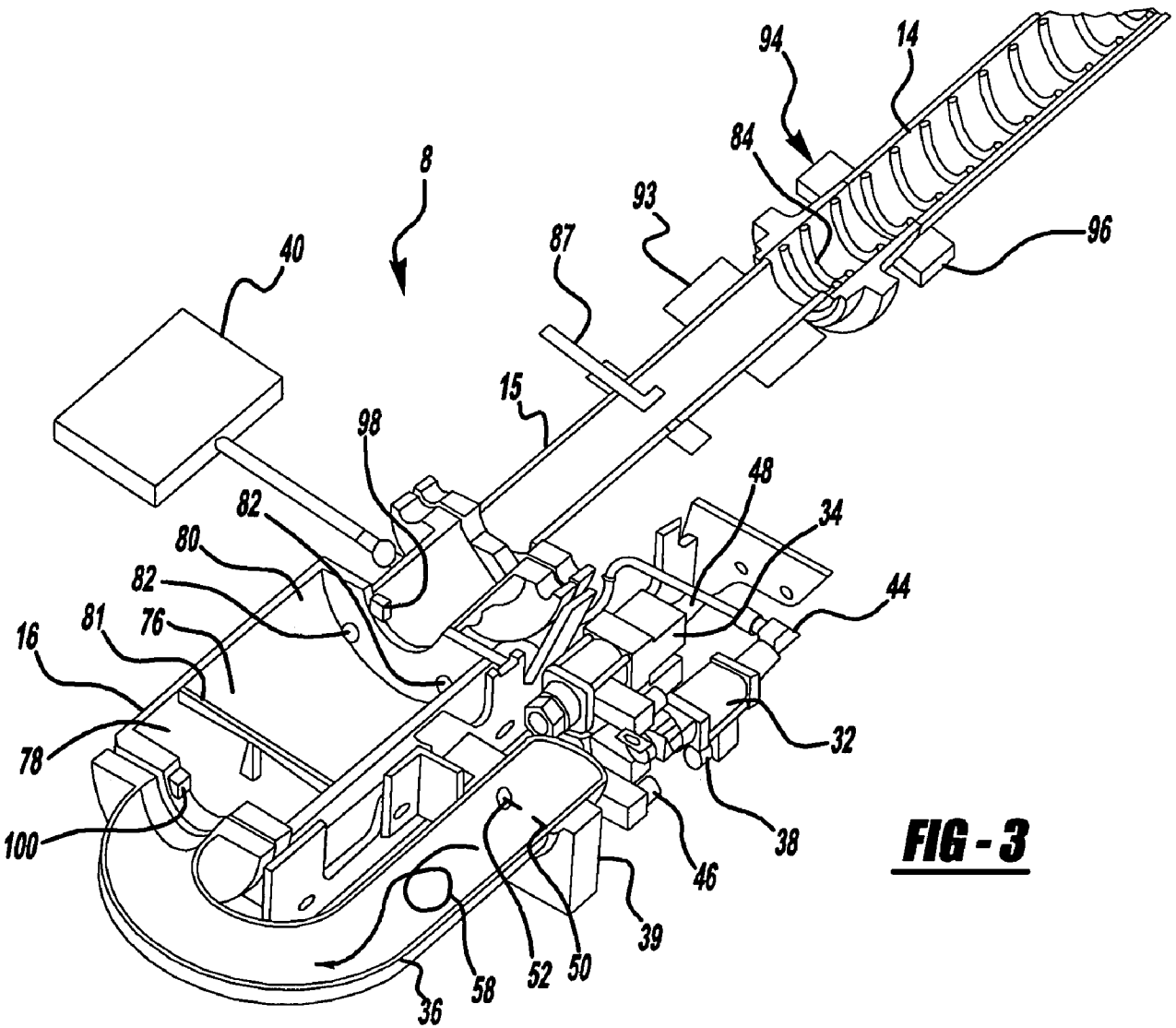
FIG. 3 is an isometric view of the sootblower shown in FIG. 1, with a portion removed above line 3-3 for illustrative purposes.
Figure 4:
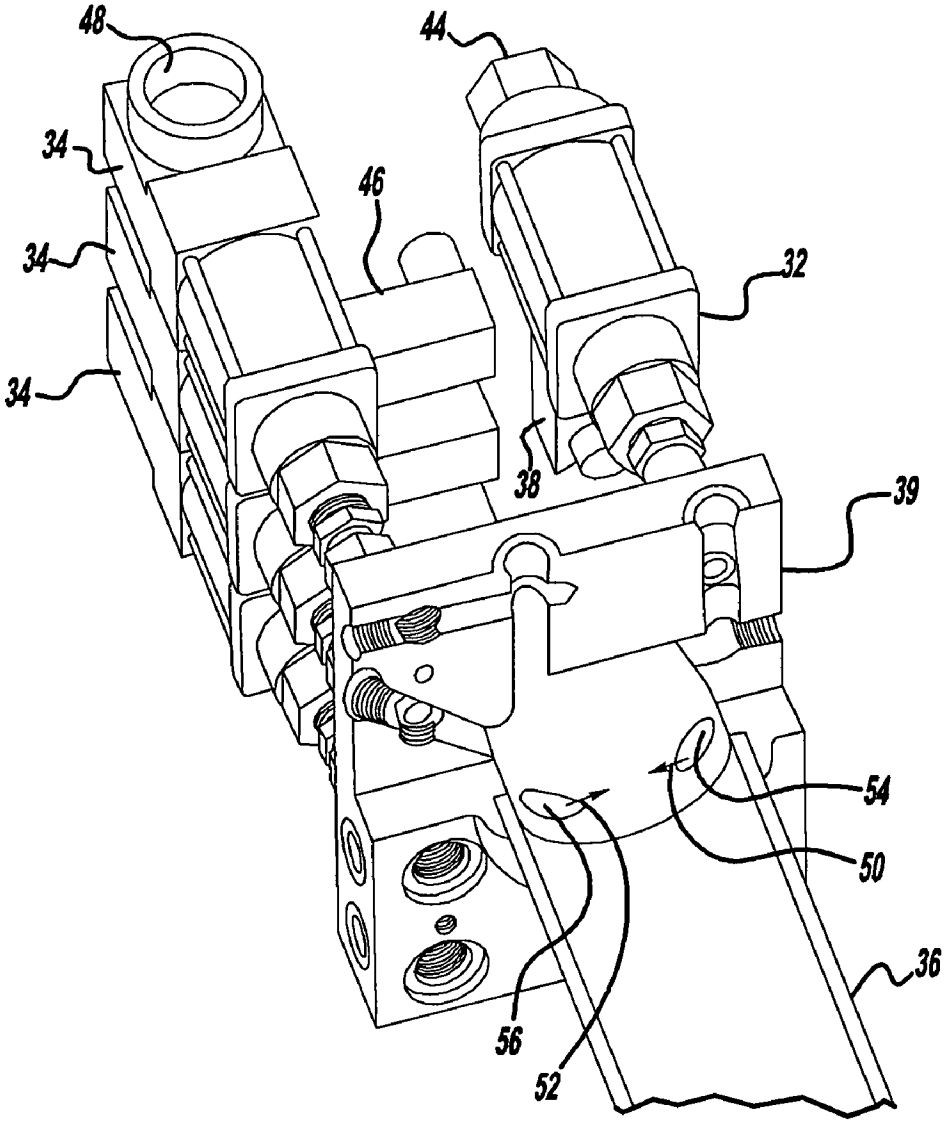
FIG. 4 is a isometric view of a fuel injector and a plurality of air injectors shown in FIG. 3 that are in fluid communication with the combustion chamber via a casing, where a portion of the casing has been removed for illustrative purposes.

Referring to FIGS. 1, 3 and 4, the combustion assembly 8 is an air-fuel combustion system having a fuel injector 32 and a plurality of air injectors 34 that deliver fuel and air from the fuel supply hose 28 and the air supply hose 30 respectively to a mixing tube 36. For example, the fuel injector 32 is a solenoid that is connected to the fuel supply hose 28 via a connecting member 44 and that is connected to the mixing tube 36 via an injection casing 39 (a portion of which has been removed in FIG. 3 for illustrative purposes. Furthermore, the fuel injector 32 is connected to a controller 40 an electrical connector 38 so that the fuel injector 32 is actuated based on output signals from the controller 40. Similarly, the bank of air injectors 34 are each solenoids that are connected to the air supply hose 30 via a connecting member 48 and that are connected to the mixing tube 36 via an injection casing 39. The air injectors 34 are each connected to the controller 40 via an electrical connector 46 so that the air injectors 34 are actuated based on output signals from the controller 40. All of the solenoids are preferably fast acting solenoid valves with an open/close response time of at least ⅕ of the combustion cycle period.

The collective capacity of the air injectors 34 should be larger than that of the fuel injector 32 because the stoichiometric combustion process requires more air mass than fuel mass. For example, the air-fuel mass ratio of air-propane mixture burning at stoichiometric condition is 15.7:1, so the air injectors 34 should be able to combine to have a mass flow rate that is 15.7 times greater than the mass flow rate of through the fuel injector 32 during the same injection period. This is critical for ensuring stoichiometric burning process because the detonation process can be hindered if the mixture is burning rich or lean. As is known in the art, the stoichiometric condition varies based on the type of fuel used in the sootblower 10.

Figure 5:
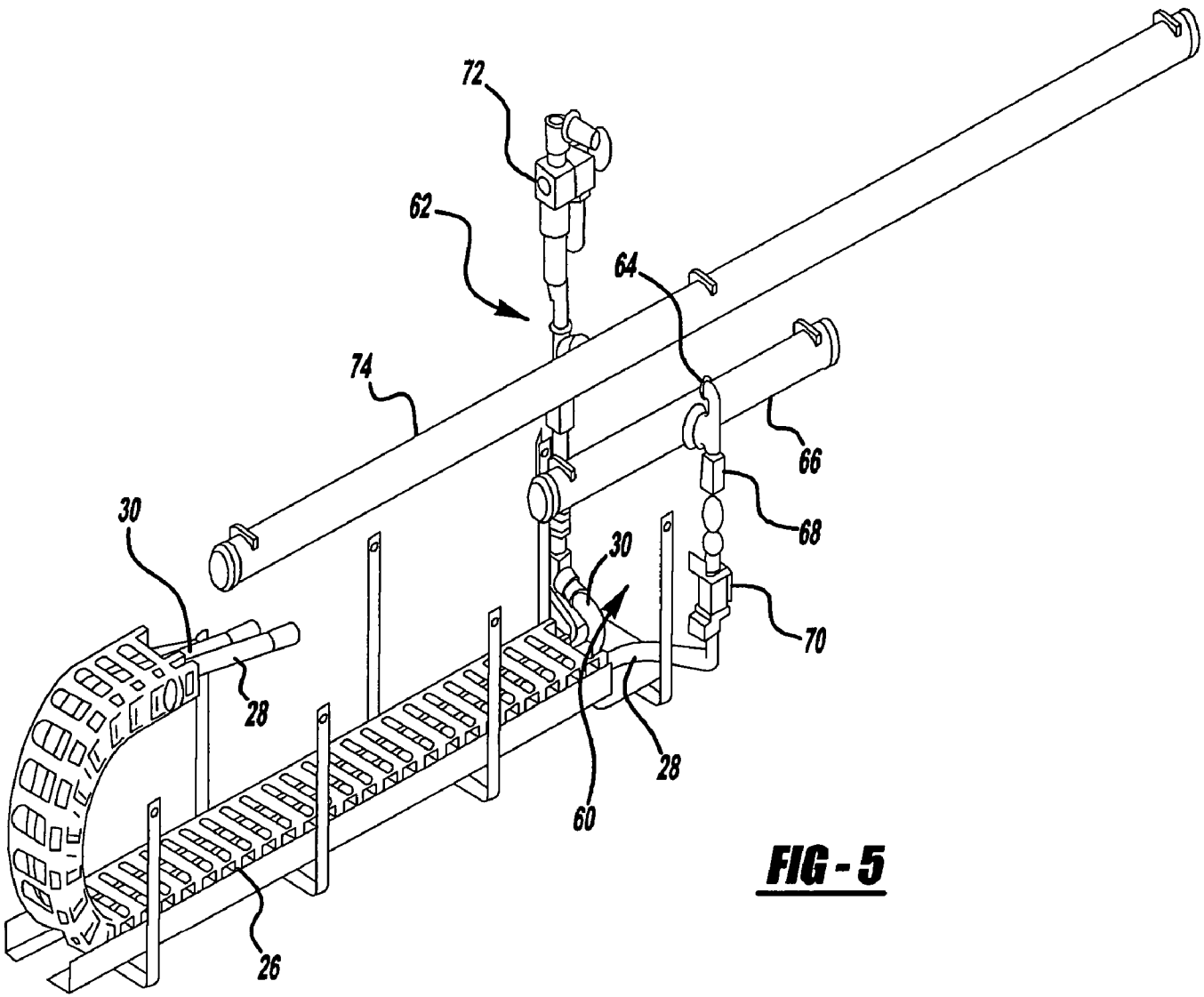
FIG. 5 is an isometric view of the sootblower in FIG. 1, with the combustion assembly and the lance tube removed for illustrative purposes.

Referring to FIG. 5, a fuel supply system 60 and an air supply system 62 are shown. The sootblower 10 shown in FIG. 5 has the following components removed for illustrative purposes: the frame assembly 12, the lance tube 14, the ignition assembly 16, and the carriage 18.

The fuel supply system 60 generally includes: a fuel inlet 64 for receiving fuel from a fuel supply such as a propane tank or a natural gas supply line (not shown), a fuel accumulator 66, a fuel orifice plate 68, a fuel isolation valve 70, the fuel supply hose 28, and the fuel injector 32. Located internally within the fuel inlet 64 are a check valve (not shown) to prevent backflow towards the fuel supply and a regulating valve (not shown) to regulate the fuel through the fuel inlet 64. Therefore, fuel is permitted to flow through the fuel inlet 64 and into the fuel accumulator 66 or towards the fuel orifice plate 68, depending on whether the fuel accumulator 66 is full. The fuel accumulator 66 compensates for any time delay in the fuel delivery into the sootblower 10. For example, the fuel should be injected into the mixing tube 26 at a particular velocity to create an effective fill within the combustion assembly 8. Therefore, an effective supply of fuel should be readily available when needed, and the fuel accumulator 66 provides such an effective supply. The fuel orifice plate 68 is sized such that a choked condition exists to further control the amount of fuel delivered to the fuel isolation valve 70 and ultimately to the fuel supply hose 28. Finally, the fuel injector 32 regulates the delivery of the fuel into the mixing tube 26, as is discussed above.

The air supply system 62 generally includes: an air filter and regulator 72, an air accumulator 74, the air supply hose 30, and the air injector. The air is able to flow from an air supply, such as a pressurized tank or ambient air, into the air filter and regulator 72 where it is filtered. Next, the air is permitted to flow into the air accumulator 74 or towards the air supply hose 30, depending on whether the air accumulator 74 is full. Similarly to the fuel accumulator 66, the air accumulator 74 compensates for any time delay in the air delivery into the sootblower 10. The air injector 34 is also used as a flow regulating mechanisms to regulate the flow into the device. Inlet pressure versus mass flow rate calibration curves are developed for the air injectors 34 so that an operator is able to control the air inlet pressure to obtain the desired fill flow rates for stoichiometric combustion.

In addition to a proper fuel-air ratio, proper mixing of air and fuel streams 50, 52 prior to ignition is also crucial in ensuring stoichiometric burning. As shown in FIGS. 3 and 4, the fuel and air streams 50, 52 are injected tangentially into the mixing tube 36 via opposing fuel and air inlets 54, 56 so that a swirling, mixed fuel-air flow 58 is generated in the mixing tube 36. The swirling action ensures proper mixing prior to ignition. An exemplary effective mixing length is approximately 5 times greater than the diameter of the mixing tube 36 to reduce the potential of flame flash back into the injection valves 32, 34. In an alternative design, the intake air and the intake fuel can be premixed and injected together as a mixed fuel-air stream, but the preferred method is to inject them through separate lines to minimize the risk of flame flash back into the injectors 32, 34.

As is known in the art of detonation, two general modes of detonation combustion initiation exist: a slow mode initiation where a flame is formed via ignition and the flame is then accelerated to cause detonation, and a fast mode initiation where detonation is formed instantaneously when a sufficient amount of energy is produced at once. A self-ignition mode typically uses air as the oxidizer and transitions from deflagration to detonation to form the pressure wave 25. Conversely, direct ignition mode typically uses oxygen as the oxidizer instead of air and transitions directly to detonation. Furthermore, self ignition mode systems require a distance between the point of ignition and the point of transition from deflagration to detonation, a distance that is commonly known as run-up distance. In the present invention, a self-initiation is preferably used by initiating a flame in the ignition chamber 16 and accelerating the flame along the feed tube 15 and along a portion of the lance tube 14 until detonation occurs. However, any other suitable process, such as direct detonation, may alternative be used with the present invention.

In furtherance of the self-initiation detonation process described above, the mixed fuel-air flow 58 flows into a combustion chamber 76 within the ignition assembly 16 and is ignited. The mixed fuel-air flow 58 flows through the mixing tube 36 at a relatively high velocity, such as 75 feet per second. If the mixed fuel-air flow 58 were to be ignited in the absence of chamber 76 at such a velocity, the boundary layers at the wall would be too thin for flame stabilization to occur. Therefore, it is beneficial to provide a mechanism for flame stabilization, such as the combustion chamber 76, which reduces the flow velocity of the mixed fuel-air flow 58 and recirculate part of the flow and continually ignites the fuel-air flow 58.

In a first exemplary design for flame stabilization, the flow area of the combustion chamber 76 is greater than the flow area of the mixing tube 36, thereby reducing flow velocities in the combustion chamber 76. For example, the combustion chamber diameter D is between 1 and 3 times larger than the mixing tube diameter $d_1$ to create a sufficient velocity drop as the fuel-air flow 58 enters the combustion chamber 76. More preferably, the combustion chamber diameter D is 3 times larger than the mixing tube diameter $d_1$. Similarly, the combustion chamber diameter D is between 1 and 3 times larger than the feed tube diameter $d_2$ to create a sufficient velocity increase as the fuel-air flow 58 exits the combustion chamber 76. More preferably, the combustion chamber diameter D is 3 times larger than the feed tube diameter $d_2$. Additionally, the length 77 of the combustion chamber 76 is preferably approximately 4 times greater than the combustion chamber diameter D.

In a second exemplary design for flame stabilization, first and second recirculation zones 78, 80 are generated near the inlet and the outlet of the combustion chamber 76. For example, the immediate change in diameter between the mixing tube 36 and the combustion chamber 76 generates the first recirculation zone 78 and causes the fuel-air flow 58 to circulate at the inlet of the combustion chamber 76. Similarly, the immediate change in diameter between the combustion chamber 76 and the lance tube 14 generates the second recirculation zone 80 and causes the fuel-air flow 58 to circulate at the outlet of the combustion chamber 76.

Figure 6A:
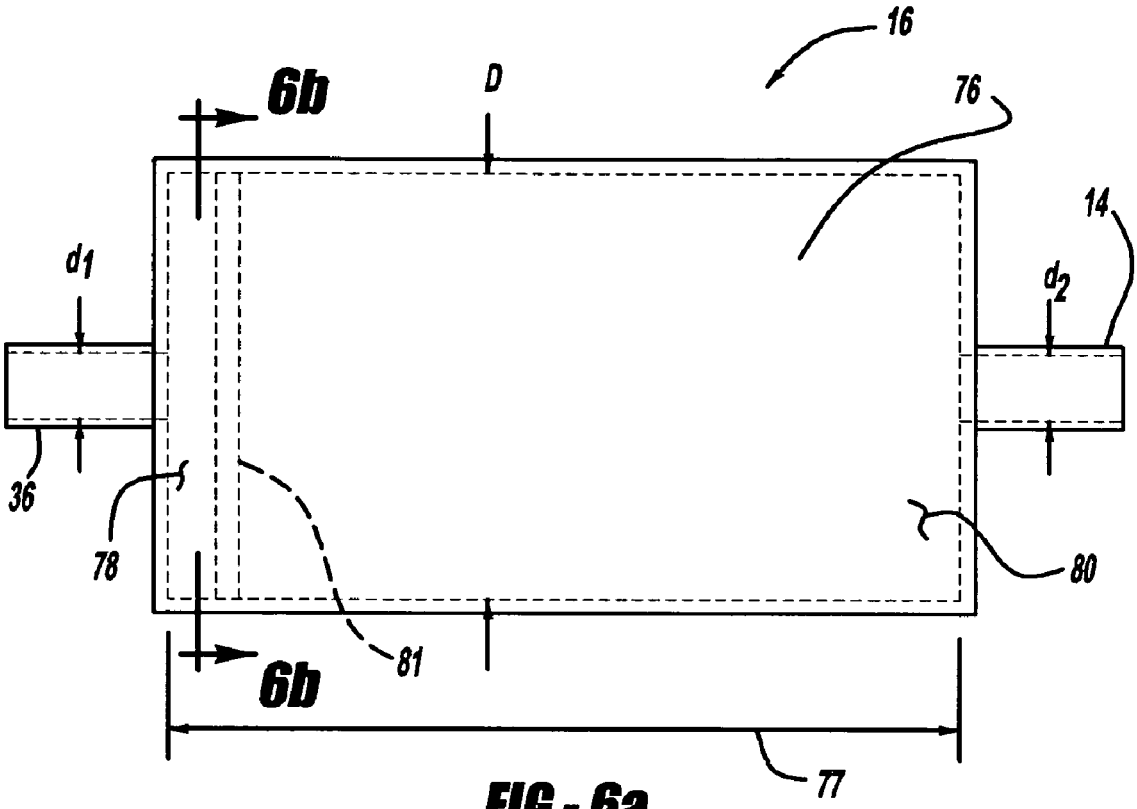
FIG. 6*a* is a side view of an ignition assembly shown in FIG. 3.
Figure 6B:
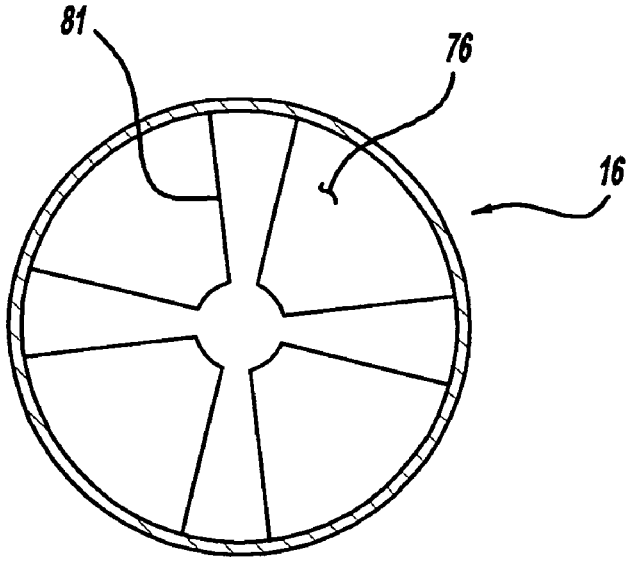
FIG. 6*b* is a cross-sectional view of the ignition assembly taken along line 6*b*-6*b* in FIG. 6*a;*

In a third exemplary design for flame stabilization, an obstruction 81 (best shown in FIGS. 6*a* and 6*b*) is provided within the combustion chamber 76 to prevent the fuel-air flow 58 from directly exiting the combustion chamber 76 before further mixing with the burnt product. For example, the obstruction 81 in the Figures is X-shaped to prevent fast moving middle streams from directly exiting the combustion chamber 76.

During testing, a device having the three above-described features has been shown to cause an additional 50% more flow to be successfully ignited compared with a design without the three features.

The fuel-air flow 58 is ignited within the combustion chamber 76 to generate the above-described flame by at least one spark plug 82 extending into the combustion chamber 76. The spark plug 82 is preferably a standard spark plug powered by a suitable power supply in order to deliver a sufficient amount of energy for starting the combustion process. One or several spark plugs may be used depending on the configuration of the combustion chamber 76 and the type of fuel used. The spark plugs 82 are preferably located at the corners of the combustion chamber 76 adjacent to the downstream end.

In furtherance of the self-initiation detonation process described above, once the flame has been formed and stabilized in the combustion chamber 76, flame acceleration is needed to transition to detonation. Although an ignited flame traveling within a tube may naturally accelerate to a point of detonation given a sufficient tube length, a tube with such a run-up distance may not be practical for use with a sootblower. Therefore, to decrease the required run-up distance, which is accomplished by achieving faster flame acceleration, an obstacle is located along the path of propagating flame to enhance volumetric burning rate thereby amplifying flame speed, which ultimately results in a generation of pressure waves 25 and eventually a transition to detonation.

The obstruction shown in FIG. 3 is a spiral flange 84 extending inwardly from the inner surface of the lance tube 14. In one example, the spiral flange 84 includes a pitch size of 15-30 degrees and a length 4-12 times greater than the lance tube diameter. Additionally, the spiral flange 84 is preferably integrally formed with the lance tube 14 so as to more effectively cool spiral flange 84, and to thereby more effectively prevent the spiral flange 84 from overheating and exceeding its structural limit. In one exemplary manufacturing method, the lance tube 14 and the obstruction are cast-formed together to form a single, unitary part.

Figure 7A:
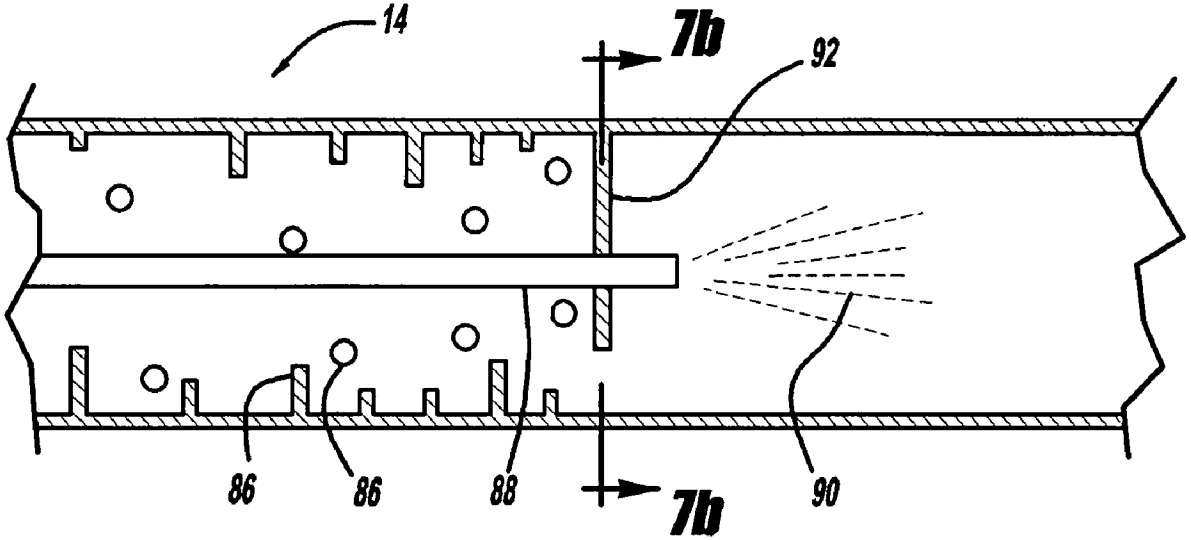
FIG. 7*a* is a partial cross-sectional view of a lance tube in an alternative design embodying the principles of the present invention.

In an alternative design, shown in FIG. 7*a*, the obstructions are cylindrical projections 86 extending inwardly from the inner surface of the lance tube 14. Similarly to the spiral flange 84, the cylindrical projections 86 are formed as an integral portion of the lance tube 14.

Figure 7B:
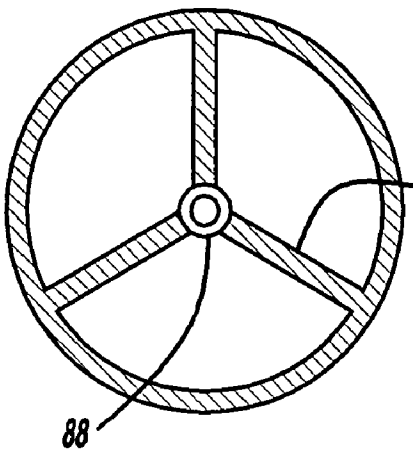
FIG. 7*b* is a cross-section taken along line 7*b*-7*b* in FIG. 7*a;*

Referring to FIG. 3, a water injector 87 extends through the feed tube 15 to emit water vapor therein and to cool the feed tube 15 and lance tube 14 walls and to reduce the danger of overheating the sootblower 10. As an alternative design, shown in FIGS. 7*a* and 7*b*, a water conduit 88 extends along a portion of the lance tube 14 and releases water vapor 90 therein to cool the lance tube walls. The water vapor 90 in this design is preferably released downstream of the combustion event to minimize impact on the transition between deflagration to detonation. The water conduit 88 is supported by an interior ring 92 having a relatively low air flow restriction.

The sootblower shown in FIG. 3 includes a packing seal 93 between the feed tube 15 and the lance tube 14 to prevent combustible gases from leaking between the lance tube 14 and the feed tube 15. In an alternative design shown in FIGS. 13*a* and 13*b*, a packing seal 95 includes a set of double seals 160, 162 with a pressurized chamber 164 therebetween. The pressure within the pressure chamber 164 is preferably higher than the operating pressure inside the lance tube 14 to prevent combustible gases from leaking through the packing seal 93. For example, as the pressure in the chamber increases, the layers of the packing seal 93 are axially compressed (in the direction of the lance tube 14 longitudinal axis). As a result of the axial compression, the layers of the packing seal 93 radially expand. The loading of the seals can be adjusted manually as the packing wears off, or alternatively the chamber can be spring loaded by a plurality of springs 168 so that periodic adjustment is not required.

To improve fuel efficiency of the sootblower 10, depending on the configuration of the sootblower 10 and the operating conditions, the lance tube 14 may have a particular length that is not filled with the mixed fuel-air flow 58. More particularly, if the distance that the lance tube travels into the boiler is indicated with "T" and a constant K is between 0.4 and 0.6, then the ideal unfilled lance tube length "Y" is preferably calculated with the following formula: Y=K*T.

The fill length is controlled by the timing of the ignition process. More particularly, the longer the injectors 32, 34 are opened, the more the lance tube will fill with the mixed fuel-air flow 58.

Referring back to FIG. 2, the distal end 24 of the lance tube 14 includes the pair of nozzles 21 to deflect the incoming pressure wave 25 by 90 degrees relative to the lance tube 14. The nozzles 21 are diametrically opposed to cancel forces urging deflection of the lance tube 14. Additionally, the shape and design of the nozzles 21 is important for maintaining an effective pressure wave 25. For example, if the nozzle 21 is restrictive and acoustically inefficient it can attenuate or completely dissipate the pressure wave 25. More specifically, the nozzles 21 are designed to have a gradually arcing surface 94 to minimize reflection of the pressure waves 25 in the backward direction, which in turn would weaken the pressure wave 25 emitted into the boiler interior volume 19. Also, the nozzle internal geometry includes a flow divider 23, and the placement of the divider is such that both jets eject pressure waves of equal intensity. For example, the flow divider 23 is positioned closer to the upstream nozzle than the downstream nozzle so that a generally equal pressure wave 25 will be emitted from each of the respective nozzles.

The controller 40 orchestrates the various events of a deflagration/detonation combustion cycle, including the cycling of the fuel injector 32 and air injector 34, igniting the spark plugs 82, and providing alarms for un-expected events. The controller 40 preferably is electrically connected to the spark plugs 82, the fuel injector 32, the air injector 34, the water injector 87, and to one or more sensors, such as a pressure feedback sensor 94, a temperature feedback sensor 96, or a pair of oxygen feedback sensors 98, 100. The controller receives inputs from some or all of the above sensors 94, 96, 98, 100 and controls the spark plugs 82, the injectors 32, 34, and the water injector 87 in response thereto. Although the feedback sensors 94, 96 are shown as being connected to the lance tube 14 in the figures, this configuration may be difficult in a rotating sootblower application. For example, the rotation of the lance tube 14 may cause any wires connected to the feedback sensors 94, 96 to become entangled. Therefore, the feedback sensors 94, 96 are preferably connected to the surface of the feed tube or are preferably wireless feedback sensors.

The controller 40 can be utilized to initiate a proper combustion. For example, one of the oxygen feedback sensors 100 is located adjacent to the upstream side of the combustion chamber 76 to measure the oxygen level in the mixed fuel-air flow 58 before combustion, and the other one of the oxygen feedback sensors 98 is located adjacent to the downstream side of the combustion chamber 76 to measure the oxygen level in the mixture of fuel and air after combustion. Consequently, the controller 40 is able to more precisely control the combustion and ensure a proper combustion. More specifically, the upstream oxygen feedback sensor 100 is utilized to determine whether the air-fuel ratio is proper and the downstream oxygen feedback sensor 98 is utilized to determine whether the mixed fuel-air flow 58 was completely combusted. Then, the controller 40 adjusts the fuel injector 32 and/or the air injector 34 to achieve the proper air-fuel ratio. More specifically, if the oxygen feedback sensors 98, 100 indicate that the air-fuel ratio is lean (lower than 15.7:1), as shown at point 106, then the air injector 34 will be restricted to reduce the airflow therethrough. Conversely, if the oxygen feedback sensors 98, 100 indicate that the air-fuel ratio is rich (higher than 15.7:1) then the fuel injector 32 will be adjusted to decrease the fuel flow therethrough. Alternatively, one oxygen sensor located downstream of ignition chamber may be used instead of two.

Figure 8:
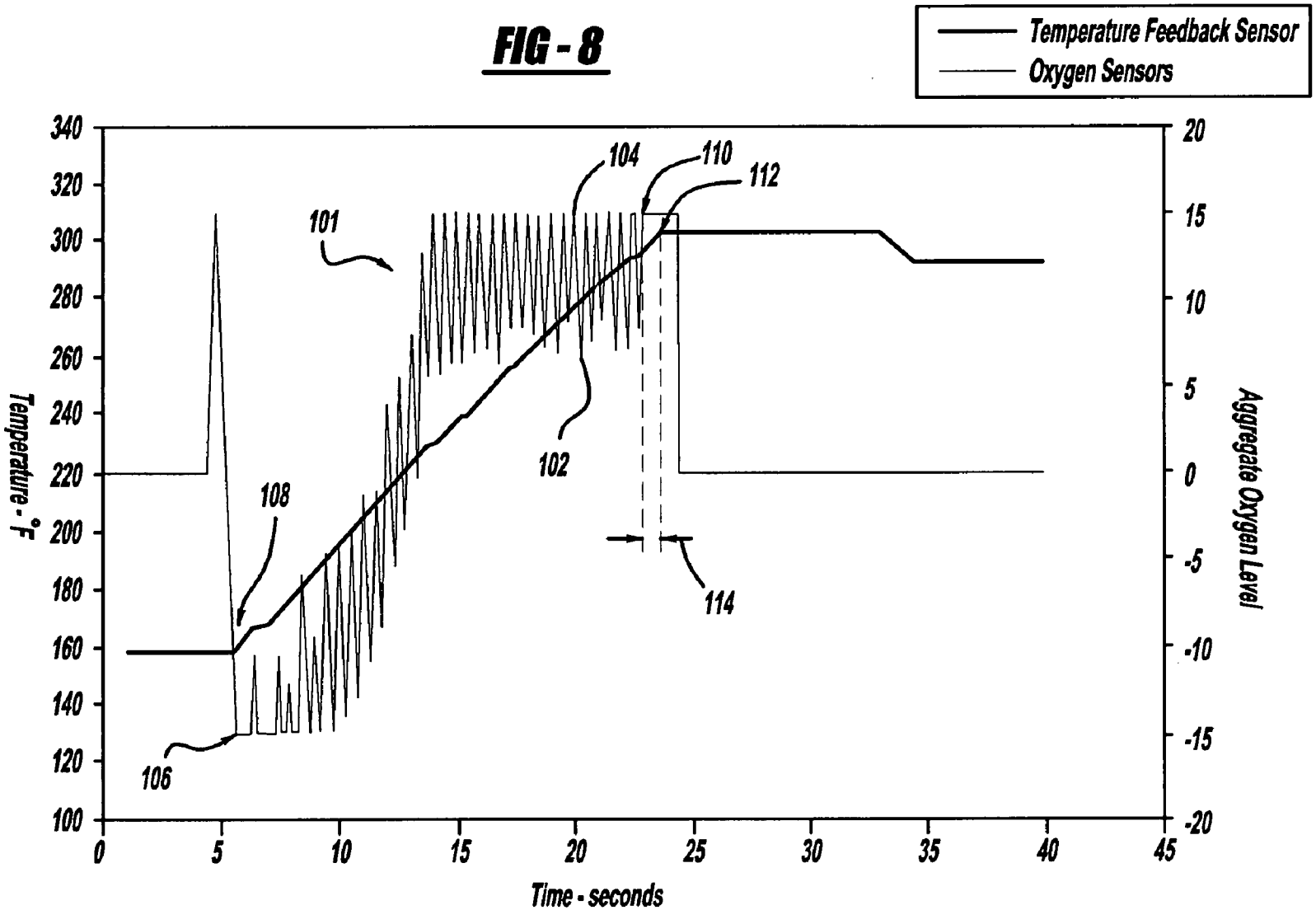
FIG. 8 is a graph plotting both the lance tube temperature versus time and the aggregate oxygen level within the combustion chamber versus time as an exemplary model of controlling the combustion assembly based on lance tube temperature and oxygen level.

The data from the respective oxygen feedback sensors 100 is aggregated by the controller. Then, as shown in FIG. 8, based on the aggregate data from the two oxygen feedback sensors 98, 100, the aggregate oxygen level has a generally oscillatory oxygen function 101 as the mixed fuel-air flow 58 is combusted. More specifically, when the spark plugs 82 are ignited and the mixed fuel-air flow 58 is combusted, the aggregate oxygen level drops dramatically to a localized trough 102 on the graph and when the fuel and air injectors 32, 34 are subsequently opened the aggregate oxygen level increases dramatically to a localized peak 104 on the graph. In the design described above having a single oxygen sensor 98, the oxygen level data is obviously recorded from the single oxygen sensor 98 rather than an aggregate data.

As another example of the controller 40 initiating a proper combustion, the controller 40 controls the timing of and the size of the combustion by controlling the timing of the spark plugs 82 and the fuel and air injectors 32, 34. As with an internal combustion engine for a motor vehicle, spark plugs 82 should be ignited when the combustion assembly 16 is filled to a desired level with the mixed fuel-air flow 58. Furthermore, as discussed above, the fill length of the lance tube 14 with the mixed fuel-air flow 58 depends on the volume of the fuel and the air that is permitted to flow through the respective injectors 32, 34. Therefore, if the frequency of the combustions is lower than the desired frequency, the controller 40 will ignite the spark plugs 82 more often. Similarly, if the combustions do not produce a desired amount of energy, the fuel and air injectors 32, 34 will be opened for a longer duration to increase the fluid flow therethrough.

In addition to controlling the characteristics of the combustion, the controller 40 also monitors whether detonation occurs within the sootblower 10. As mentioned above, if detonation fails to occur, then the pressure wave 25 may not be strong enough to effectively loosen the deposits 29 on the boiler tubes 27. Under this scenario, the operation of the sootblower 10 should be compensated to prevent undesirable build-up of the deposits 29. For example, in one design the controller 40 alerts a sootblower operator that detonation has failed to occur so that the operator can operate the sootblower for a greater duration of time or so that the operator can undertake another corrective action, such as performing maintenance on the sootblower 10. In another design, the controller 40 automatically undertakes a corrective action, such as operating the sootblower for a greater duration of time or adjusting the respective injectors 32, 34 until detonation occurs.

In one embodiment, the pressure feedback sensor 94 is utilized to determine whether detonation has occurred. For example, when detonation occurs the shock wave traveling across the lance tube 14 increases the local pressure across the shockwave dramatically. Meanwhile, rarefaction waves traveling in the opposite direction to the shock waves raise the pressure at the feed tube 15 to a lesser degree. Therefore, the pressure feedback sensor 94 is preferably positioned on an outer surface of feed tube 15 or the lance tube 14. More preferably, to prevent heat damage thereto, the pressure feedback sensor 94 is positioned on a portion of the lance tube 14 that does not typically enter the boiler interior volume 19 when the lance tube is in the operational position 14*b*.

When detonation occurs, the pressure feedback sensor 94 measures a relatively high shock wave for a relatively short time duration. Due to the short duration of the shock wave, the controller 40 must have a very high recording speed. For example, in one design, the controller 40 records over 1,000,000 data points per second. Relatively complex and expensive hardware and software is required to analyze such a high number of data points in a timely fashion. Therefore, rather than evaluating each data point that is recorded, the controller 40 detects data points having values above a certain threshold. Then, during operation of the sootblower 10, if the controller 40 fails to detect a data point having a value above the threshold for a predetermined amount of time, the controller 40 alerts the operator or performs internal corrective actions. For example, if a particular sootblower 10 typically produces pressure peaks greater than 100 pounds per square inch (psi) during normal detonation, and the sootblower 10 is operating at a frequency of 2 Hertz (2 combustion cycles per second), then the controller 40 alerts the operator or performs internal corrective actions if it fails to detect a data point having a value of at least 100 psi every 0.5 seconds.

As a design modification, the controller 40 may be programmed to wait for a predetermined number of detected failed detonations before alerting the operator or performing internal corrective actions. This design modification may be particularly desirable because an occasional failed detonation or a relatively small amount of failed detonations may not substantially degrade the performance of the sootblower 10 and because it may be time-consuming or inefficient for the controller 40 to frequently alert the operator or to perform internal corrective actions.

In a second embodiment, the temperature feedback sensor 96 is utilized to determine whether detonation has occurred. When detonation occurs the temperature within the sootblower 10, particularly within the feed tube 15 and the lance tube 14, increases dramatically. However, when detonation fails to occur or ceases to occur, the temperature within the feed tube 15 and the lance tube 14 ceases to increase and/or starts to decrease. Furthermore, the temperatures of the exterior surface of the feed tube 15 and the lance tube 14 are directly related to the temperatures of the internal temperatures of the respective components 15, 14. Therefore, the temperature feedback sensor 96 is preferably positioned on an outer surface of feed tube 15 or the lance tube 14. More preferably, to prevent heat damage thereto, the temperature feedback sensor 96 is positioned on a portion of the lance tube 14 that does not typically enter the boiler interior volume 19 when the lance tube is in the operational position 14*b*.

When detonation occurs, as indicated by point 108 in FIG. 8, the values reported by the temperature feedback sensor 96 increase. The experimental results shown in FIG. 8 confirm that detonation did in fact occur at point 108 because the aggregate oxygen level oscillates drastically. Conversely, shortly after the aggregate oxygen level ceases to oscillate (at point 110 in FIG. 8), indicating that detonation has ceased to occur, the values detected by the temperature feedback sensor 96 plateau (at point 112 in FIG. 8) and eventually decline. Although a time gap 114 is present between the failed detonation at point 110 and the temperature plateau at point 112, the time gap 114 is relatively small (approximately 1 second). Therefore, the temperature feedback sensor 94 provides a relatively simple and accurate system for detecting detonation failure.

The pressure feedback sensor 94 and the temperature feedback sensor 96 are both shown as being utilized in the embodiment in FIG. 3. In this embodiment the respective sensors 94, 96 may serve redundant or back-up detonation detection roles with respect to each other. However, in an alternative embodiment, only one of the respective sensors 94, 96 is present.

Figure 9:
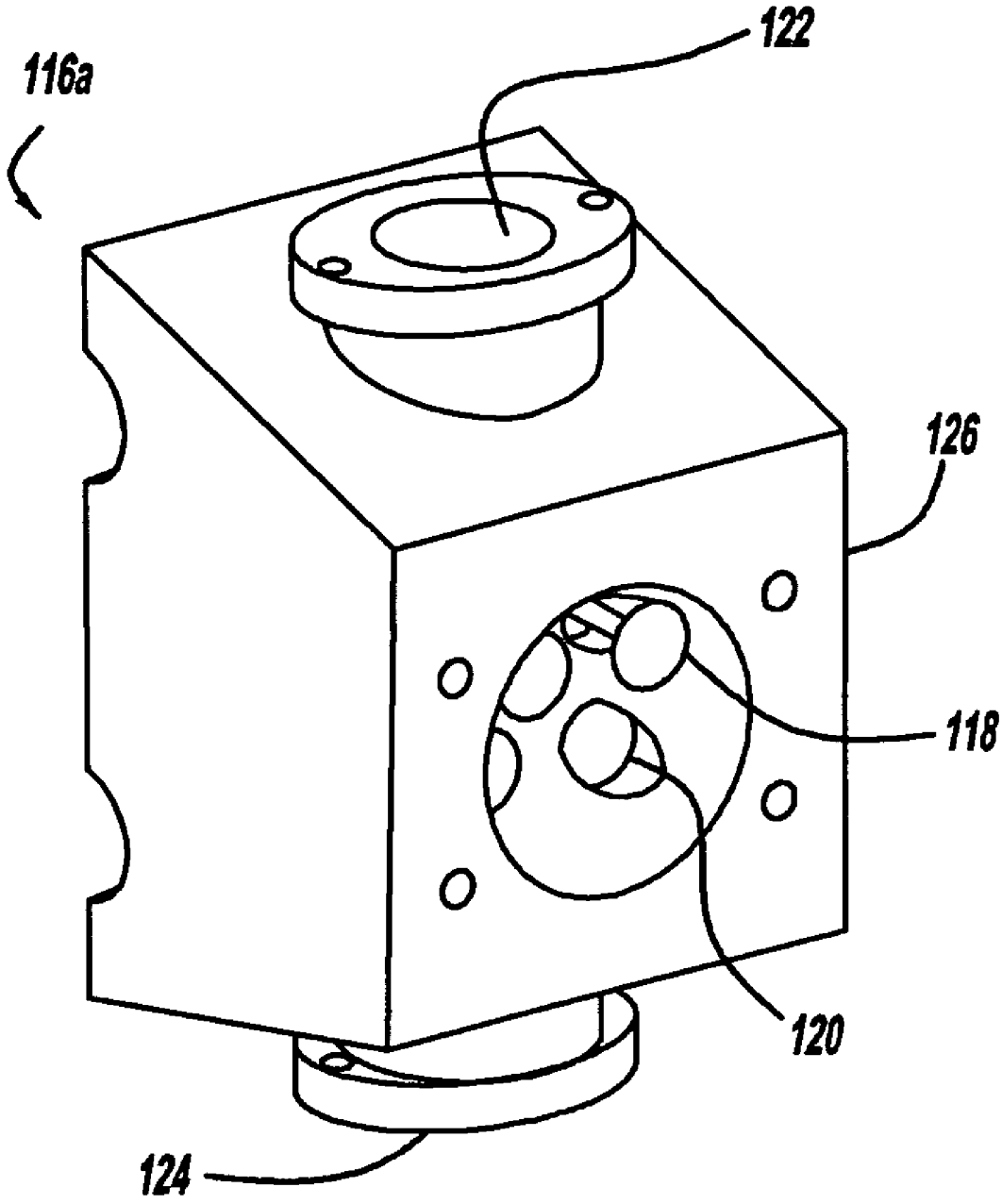
FIG. 9 is an alternative configurations of an injection block in an alternative design embodying the principles of the present invention.
Figure 10:
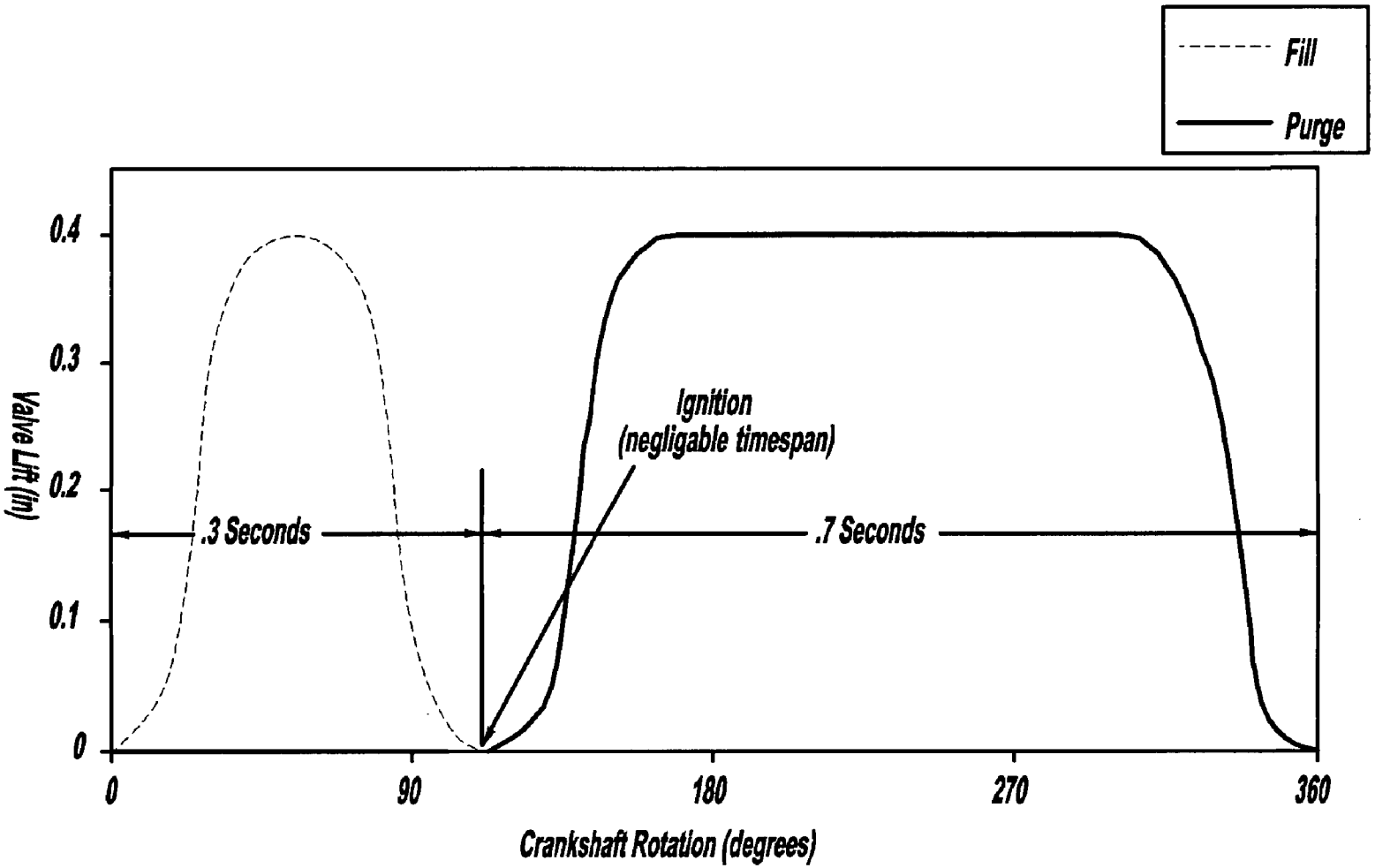
FIG. 10 is a graph plotting a detonation cycle the injection block shown in FIG. 9.

Referring now to FIGS. 9-10, an alternative design for injecting the fuel-air mixture into the mixing tube 26 is shown. More specifically, an assembly including intake-exhaust valves, referred to as an injection block 116 may be used to deliver fuel and air to the mixing tube 26.

In one design, the injection block 116 shown in FIG. 9 includes a plurality of linearly actuating intake valves 118 and purge valves 120 that are coupled to an intake conduit 122 and a purge conduit 124. For example, the intake valves 118 permit a mixture of fuel and air to flow into the combustion chamber 76 during a fill mode of the combustion cycle and the purge valves 120 permit, fresh air only to flow into the combustion chamber 76 during a fill mode of the combustion cycle (after the mixture of fuel and air has been ignited). The valves 118, 120 are housed within a casing 126 that defines the respective intake conduits 122, 124 and that supports a plurality of actuating devices (not shown). Both of the valves 118, 120 are mechanically-driven by a rotating device, such as a cam (not shown). As the cam rotates, the respective valves 118, 120 also rotate and control the input of mixed fuel and air into the injection block 116 and to control the output of the combustion gases from the injection block 116. The valves 118, 120 are preferably off-set from each other such that one of the valves is closed when the other is open, and vise-versa. The valve designs are such that it allows for uneven fill & exhaust duration. For example the valves 118, 120 may have an unsymmetrical profile to provide a longer purge time than fill time, as shown in FIG. 10. In an alternative design, the injection block may have more purge valves than fill valves to promote an uneven fill & exhaust duration.

Figure 11B:
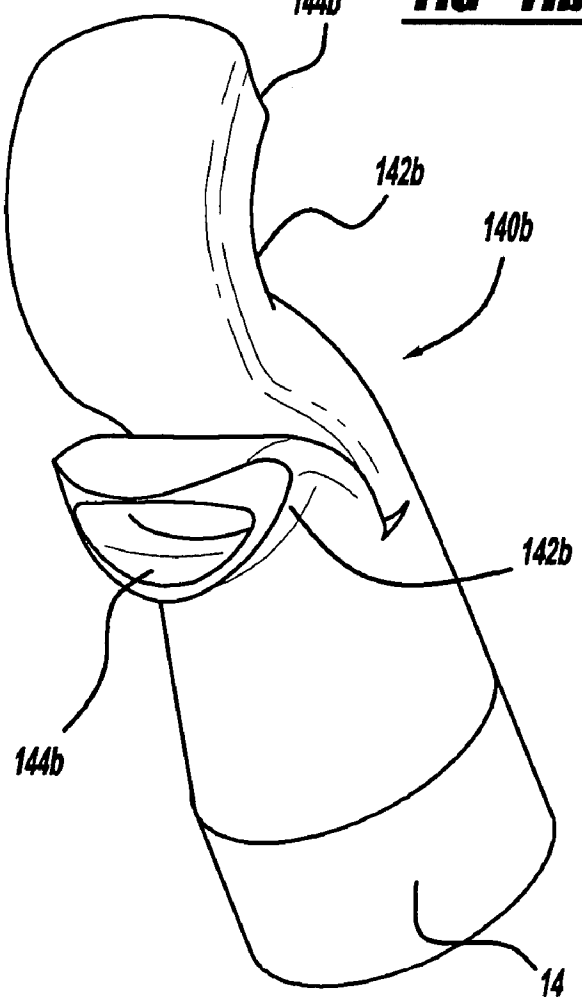
FIGS. 11*a* and 11*b* are first and second alternative configurations of the nozzle shown in FIG. 2.
Figure 11A:
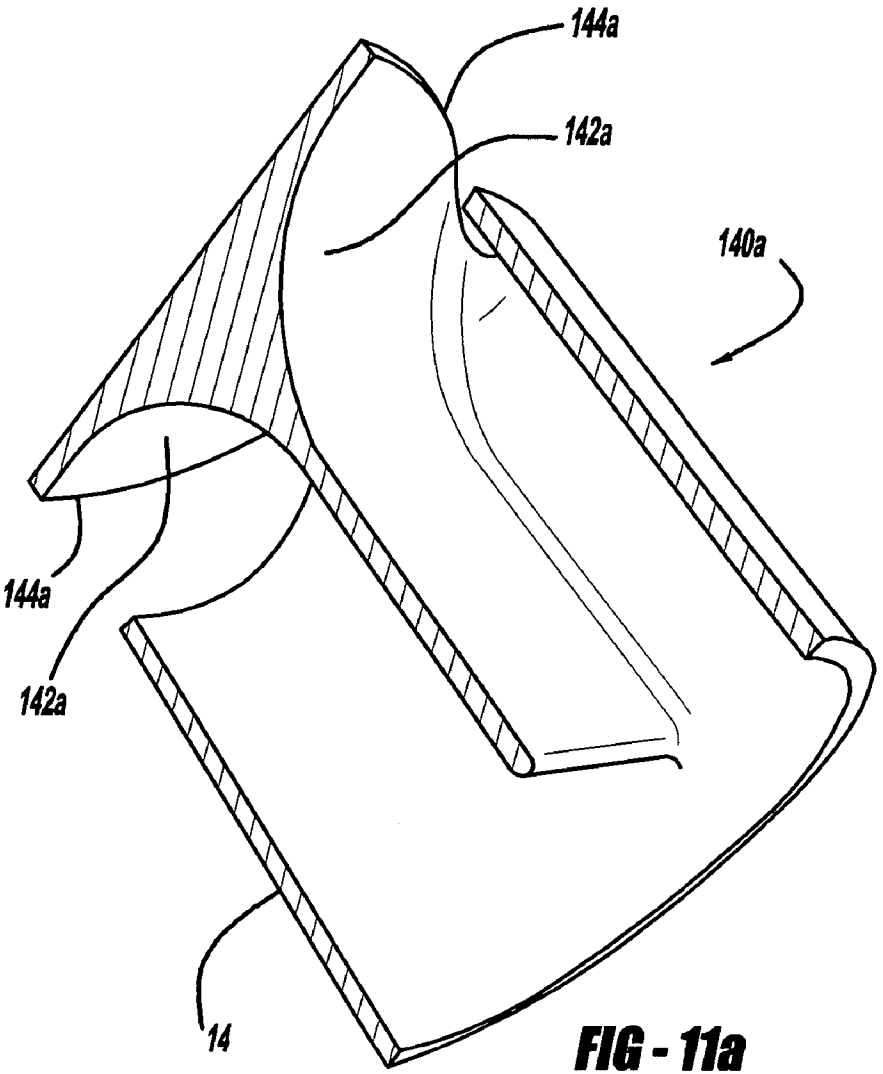

Referring now to FIGS. 11*a* and 11*b*, two alternative nozzle configurations 140*a*, 140*b* are shown. Both nozzle designs 140*a*, 140*b* include a pair of diametrically opposed outlets 144*a*, 144*b* and a generally smooth, generally gradual arcuate portion 142*a*, 142*b* connecting the body portion of the lance tube body 14 to the outlets 144*a*, 144*b*. The gradual sloping portions minimize reflection of the shock waves back into the lance tube 14 and thereby maximize the strength of the shock waves entering the boiler interior volume 19.

Figure 12A:
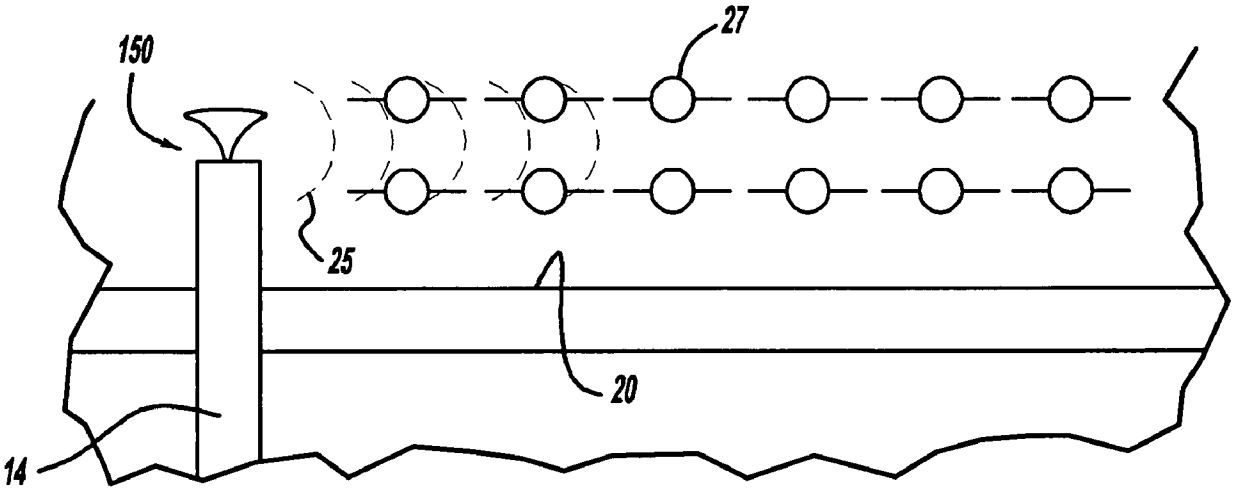
FIGS. 12*a* and 12*b* are third and fourth alternative configurations of the nozzle shown in FIG. 2 being inserted within the interior volume of the boiler.
Figure 12B:
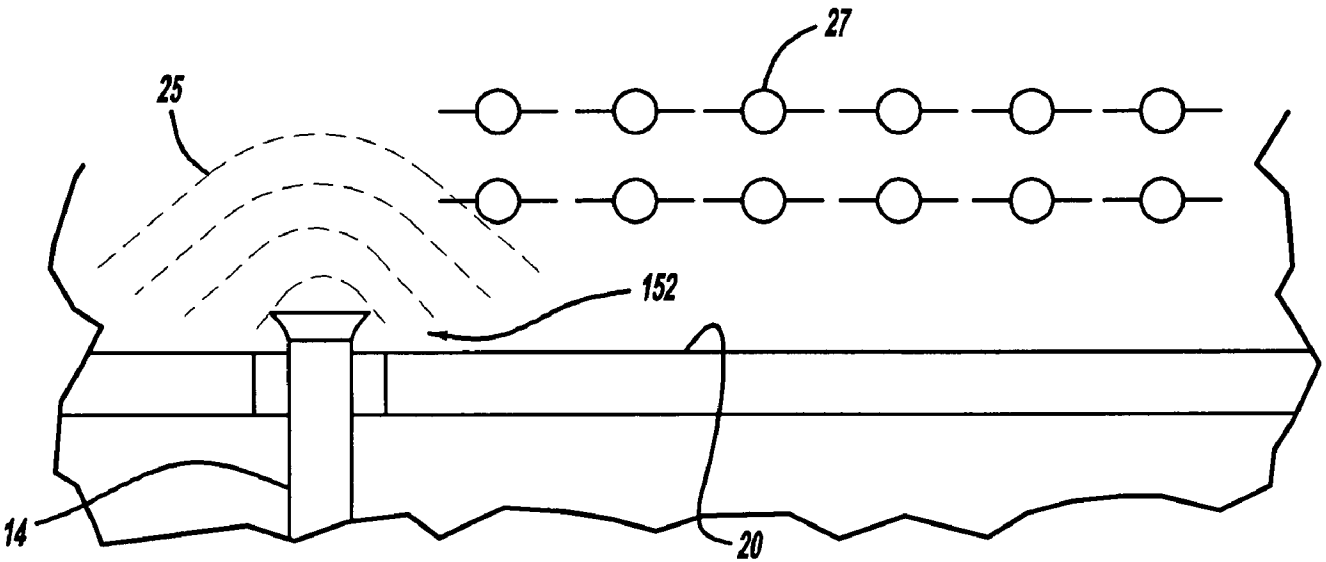

FIGS. 12*a* and 12*b* depict more fundamental characteristics of nozzle designs 150, 152; namely the direction of travel of the shock waves caused by the nozzles 150, 152. The nozzle 150 shown in FIG. 12*a* causes the shock waves to undergo a 90 degree turn before exiting the lance tube 14, whereas the nozzle 152 shown in FIG. 12*b* causes the shock waves to exit the lance tube in a direction parallel to the lance tube longitudinal axis. The nozzle 15 preferably includes a flared profile to radially dissipate the shock waves.

One type of sootblower embodying the principles of the present invention is a rotating, traversing detonation sootblower. The rotating, traversing detonation sootblower typically rotates in a single direction and typically has a range of rotation of 360 degrees. A rotating detonation sootblower may have a more expansive cleaning area than a non-rotating detonation sootblower because the rotating detonation sootblower is not limited to a cleaning area in a particular radial direction from the axial direction (where the axial direction is defined as the axis of traversing movement of the sootblower lance).

Another type of sootblower embodying the principles of the present invention is an oscillating, traversing detonation sootblower. The oscillating, traversing detonation sootblower typically rotates in two directions and typically has a range of rotation of less than 360 degrees.

Yet another type of sootblower embodying the principles of the present invention is a non-rotating, non-oscillating, traversing sootblower. The non-rotating, non-oscillating, traversing sootblower typically inherently has a coverage area that is more limited than that of the rotating or oscillating sootblowers.

Another type of sootblower embodying the principles of the present invention is a non-traversing sootblower. Because the non-traversing sootblower is preferably able to dean boiler tubes that are furthest away from the boiler wall, and because the shock waves decay during the travel between the sootblower nozzle and the boiler tubes, the shock wave is preferably relatively strong when emitted from the sootblower. However, this may cause damage to the boiler tubes located relatively dose to the sootblower nozzle.

It is therefore intended that the foregoing detailed description be regarded as illustrative rather than limiting, and that it be understood that it is the following claims, including all equivalents, that are intended to define the spirit and scope of this invention.

The invention claimed is:

1. A sootblower for cleaning a plurality of surfaces within an interior volume of a combustion device, the sootblower comprising:

a combustion assembly configured to generate a pressure wave;

a delivery assembly defining a pressure wave path extending in a substantially linear direction between the combustion assembly and an outlet portion of the delivery assembly; and a translating assembly configured to translate the delivery assembly in a forward direction, from a resting position to an operational position, along a translation path generally parallel to the pressure wave path to selectively position the outlet portion of the delivery assembly within the interior volume of the combustion device and deliver the pressure wave along the pressure wave path, in the forward direction, into the volume of the combustion device and remove deposits from the surfaces of the combustion device.

2. A sootblower as in claim 1, wherein the outlet portion includes a generally non-linear portion to guide the pressure wave towards the surfaces of the combustion device.

3. A sootblower as in claim 2, wherein the non-linear portion is a divergent section to emit the pressure wave in a direction substantially perpendicular to the pressure wave path.

4. A sootblower as in claim 3, wherein the outlet portion includes a pair of diametrically opposed nozzles.

5. A sootblower as in claim 4, wherein the nozzles are separated by a divider such that the pressure wave exits each of the nozzles with a generally equal intensity.

6. A sootblower as in claim 4, wherein the delivery assembly includes a lance tube and the outlet portion includes a pair of diametrically opposed slots formed in a distal end of the lance tube.

7. A sootblower as in claim 1, wherein the outlet portion is configured to emit the pressure wave in a direction substantially parallel with the pressure wave path.

8. A sootblower as in claim 7, wherein the outlet portion includes a generally linear profile.

9. A sootblower as in claim 1, wherein the outlet portion is configured to rotate with respect to the surfaces of the combustion device to control a projection of the pressure wave.

10. A sootblower as in claim 1, wherein the combustion assembly is configured to generate the pressure wave via a detonation combustion event.

11. A sootblower as in claim 1, wherein the combustion assembly is configured to generate the pressure wave via a deflagration combustion event.

12. A sootblower as in claim 1, wherein the delivery assembly includes at least one obstruction extending an obstruction length along the fuel/oxidizer flow path, downstream of ignition chamber, to increase the velocity of the combustion flame, wherein the at least one obstruction defines an obstruction diameter and the obstruction length is at least 10 times greater than the obstruction diameter.

13. A sootblower as in claim 12, wherein the at least one obstruction is a generally spiral-shaped ridge extending from a wall of the delivery assembly.

14. A sootblower as in claim 12, wherein the at least one obstruction is integrally formed with a wall of the delivery assembly.

15. A sootblower as in claim 1, wherein the combustion assembly includes an ignition chamber configured to receive fuel and an oxidizer, an obstruction to increase turbulence within the ignition chamber and to promote mixing of the fuel and the oxidizer, and an ignition element configured to ignite the fuel.

16. A sootblower as in claim 15, wherein the ignition chamber defines an ignition chamber diameter, the delivery assembly defines a delivery assembly diameter, and a ratio of the ignition chamber diameter to the delivery assembly diameter is between 1 and 3.

17. A sootblower as in claim 15, wherein the ignition chamber defines an ignition chamber axial length and a ratio of the ignition chamber axial length to the ignition chamber diameter is between 1 and 4.

18. A sootblower as in claim 1, wherein the combustion assembly is configured to generate repeated pressure waves.

19. A sootblower as in claim 1, further comprising an injection block coupled with the combustion assembly, wherein the injection block includes an intake valve to deliver a fluid to the combustion assembly and an exhaust valve to purge the combustion assembly, wherein the intake valve and the exhaust valve are both mechanically driven.

20. A sootblower for cleaning a plurality of surfaces within an interior volume of a combustion device, the sootblower comprising:

a combustion assembly configured to generate a pressure wave;

a delivery assembly coupled to the combustion assembly and configured to deliver the pressure wave to the interior volume and remove deposits from the surfaces of the combustion device; and a combustion detection assembly coupled to the delivery assembly and including a temperature sensor directly connected to the delivery assembly to measure a sootblower temperature for detecting an unsuccessful detonation event.

21. A sootblower as in claim 20, further comprising a controller electrically connected with the temperature sensor and configured to control the combustion assembly based on a gradient of the sootblower temperature.

22. A sootblower as in claim 20, wherein the combustion assembly is configured to generate repeated pressure waves.

23. A sootblower for cleaning a plurality of surfaces within an interior volume of a combustion device, the sootblower comprising:

a combustion assembly configured to generate a pressure wave; and a delivery assembly defining a pressure wave path extending between the combustion assembly and an outlet portion of the delivery assembly, wherein the delivery assembly includes a first section and a second section slidably received within the first section to define an overlapping portion having an adjustable overlapping length wherein the second section is a feed tube and the first section is a lance tube configured to rotate with respect to the feed tube, wherein the delivery assembly is configured to deliver the pressure wave from the outlet portion to the interior volume to remove deposits from the surfaces of the combustion device, wherein the pressure wave path has an adjustable length, and wherein the first section is movable between a first position second section and wherein a portion of the first section is positioned within the interior volume when the first section is in the second position.

24. A sootblower as in claim 23, wherein the delivery assembly is able to deliver the pressure wave from the outlet portion at various lengths of the adjustable length.

25. A sootblower as in claim 23, further comprising a seal assembly connected with the first section and the second section to define a pressure chamber having a seal pressure that is greater than an operating pressure within the delivery assembly to prevent gas from leaking through the seal assembly.

26. A method of cleaning a plurality of surfaces within an interior volume of a combustion device with a sootblower having a combustion assembly and a delivery assembly, the method comprising:

generating a pressure wave within the combustion assembly;

translating the delivery assembly along a delivery assembly path extending into the interior volume of the combustion device; and delivering the pressure wave, along a pressure wave path between the combustion assembly and an outlet portion of the delivery assembly, to the interior volume of the combustion device to remove deposits from the surfaces of the combustion device while translating the delivery assembly along the delivery assembly path, wherein the pressure wave path and the delivery assembly path are generally parallel with each other.

27. A method of cleaning as in claim 26, further comprising rotating a portion the delivery assembly to control a direction of the pressure wave within the combustion assembly.

28. A method of cleaning as in claim 26, further comprising measuring a sootblower temperature of at least one of the combustion assembly and the delivery assembly.

29. A method of cleaning as in claim 26, further comprising controlling the combustion assembly based on detecting a threshold pressure measured by a pressure signal.

30. A method of cleaning as in claim 26, further comprising generating a plurality of repeated pressure waves within the combustion assembly.

31. A method of cleaning as in claim 26, further comprising controlling a fuel/oxidant fill length to adjust an intensity of the pressure wave.

* * * * *

UNITED STATES PATENT AND TRADEMARK OFFICE

CERTIFICATE OF CORRECTION

PATENT NO. : 7,360,508 B2
APPLICATION NO. : 11/152577
DATED : April 22, 2008
INVENTOR(S) : Tony F. Habib et al.

It is certified that error appears in the above-identified patent and that said Letters Patent is hereby corrected as shown below:

On the Title page item (75), Under Inventors

Steven L. Shover, please correct "Steven" to read --Stephen--.

Signed and Sealed this

Ninth Day of December, 2008

JON W. DUDAS
*Director of the United States Patent and Trademark Office*